US011034470B2

(12) United States Patent
Lancaster, III et al.

(10) Patent No.: US 11,034,470 B2
(45) Date of Patent: Jun. 15, 2021

(54) STRETCH WRAPPING MACHINE WITH AUTOMATIC LOAD PROFILING

(71) Applicant: Lantech.com, LLC, Louisville, KY (US)

(72) Inventors: Patrick R. Lancaster, III, Louisville, KY (US); Michael P. Mitchell, Louisville, KY (US); Richard L. Johnson, LaGrange, KY (US)

(73) Assignee: LANTECH.COM, LLC, Louisville, KY (US)

( * ) Notice: Subject to any disclaimer, the term of this patent is extended or adjusted under 35 U.S.C. 154(b) by 191 days.

(21) Appl. No.: 15/762,501

(22) PCT Filed: Sep. 22, 2016

(86) PCT No.: PCT/US2016/053165
§ 371 (c)(1),
(2) Date: Mar. 22, 2018

(87) PCT Pub. No.: WO2017/053603
PCT Pub. Date: Mar. 30, 2017

(65) Prior Publication Data

US 2018/0273218 A1 Sep. 27, 2018

Related U.S. Application Data

(60) Provisional application No. 62/232,915, filed on Sep. 25, 2015.

(51) Int. Cl.
*B65B 11/02* (2006.01)
*B65B 57/12* (2006.01)
(Continued)

(52) U.S. Cl.
CPC ..... *B65B 11/025* (2013.01); *B65B 11/045* (2013.01); *B65B 57/12* (2013.01);
(Continued)

(58) Field of Classification Search
CPC ..... B65B 11/025; B65B 57/14; B65B 57/12; B65B 57/16; B65B 11/045;
(Continued)

(56) References Cited

U.S. PATENT DOCUMENTS 2,076,617 A 4/1937 Cleaves
2,227,398 A 12/1940 Mohl
(Continued)

FOREIGN PATENT DOCUMENTS

AU 2016246778 A1 11/2017
CA 2277316 A1 1/2001
(Continued)

OTHER PUBLICATIONS

Petronio,S. Going the Distance. Machine Design 76.10 (2004): 3, S8, S10, S12. (Year: 2004).
(Continued)

*Primary Examiner* — Hemant Desai
*Assistant Examiner* — Christopher Robin Kim
(74) *Attorney, Agent, or Firm* — Middleton Reutlinger

(57) ABSTRACT

A method, apparatus and program product perform automatic load profiling to optimize a wrapping operation performed with a stretch wrapping machine. Automatic load profiling may be performed, for example, to determine a density parameter for a load that is indicative of load stability such that one or more control parameters may be configured for a wrapping operation based upon the density parameter. Automatic load profiling may also be performed, for example, to detect a load with a nonstandard top layer, e.g., a load with a top or slip sheet, a load with an easily deformable top layer, a load with a ragged top surface topography and/or a load with an inboard portion, such that a top layer containment operation may be activated during wrapping to optimize containment for the load.

52 Claims, 20 Drawing Sheets

(51) Int. Cl.

| | |
|---|---|
| ***B65B 57/16*** | (2006.01) |
| ***B65B 11/04*** | (2006.01) |
| ***B65B 57/14*** | (2006.01) |
| ***B65D 71/00*** | (2006.01) |
| *B65B 11/00* | (2006.01) |

(52) U.S. Cl.

CPC ..... *B65B 57/14* (2013.01); *B65B 57/16* (2013.01); *B65D 71/0088* (2013.01); *B65B 2011/002* (2013.01); *B65B 2210/04* (2013.01); *B65B 2210/18* (2013.01); *B65B 2210/20* (2013.01)

(58) Field of Classification Search

CPC ..... B65B 2011/002; B65B 2210/04; B65B 2210/18; B65B 2210/20; B65D 71/0088

USPC ..... 53/399, 587, 588, 211, 441, 203, 461, 53/502–504, 556

See application file for complete search history.

(56) References Cited

U.S. PATENT DOCUMENTS 2,904,196 A 9/1959 Teixeira
3,029,571 A 4/1962 Douthit
3,707,658 A 12/1972 Hilsenbeck
3,815,313 A 6/1974 Heisler
3,867,806 A 2/1975 Lancaster, III
3,910,005 A 10/1975 Thimon et al.
4,077,179 A 3/1978 Lancaster
4,079,566 A * 3/1978 Stoecklin ..... B65D 71/00 53/399
4,152,879 A 5/1979 Shulman
4,216,640 A 8/1980 Kaufman
4,235,062 A 11/1980 Lancaster, III et al.
4,271,657 A 6/1981 Lancaster, III et al.
4,281,500 A 8/1981 Mueller et al.
4,300,326 A 11/1981 Stackhouse
4,387,548 A 6/1983 Lancaster et al.
4,395,255 A 7/1983 Branecky et al.
4,418,510 A 12/1983 Lancaster, III et al.
4,429,514 A 2/1984 Lancaster et al.
4,432,185 A 2/1984 Geisinger
4,458,467 A 7/1984 Shulman et al.
4,497,159 A 2/1985 Lancaster, III
4,501,105 A 2/1985 Rogers et al.
4,503,658 A 3/1985 Mouser et al.
4,505,092 A 3/1985 Bowers et al.
4,514,955 A 5/1985 Mouser et al.
4,524,568 A 6/1985 Lancaster et al.
4,545,182 A 10/1985 McDowell, Jr.
4,590,746 A 5/1986 Humphrey
4,628,667 A 12/1986 Humphrey et al.
4,631,898 A 12/1986 Brambilla
4,676,048 A 6/1987 Lancaster et al.
4,693,049 A 9/1987 Humphrey
4,712,354 A 12/1987 Lancaster et al.
4,712,686 A 12/1987 Lancaster et al.
4,726,172 A 2/1988 Widenback
4,736,567 A 4/1988 Pienta
4,754,594 A 7/1988 Lancaster
4,761,934 A 8/1988 Lancaster
4,807,427 A 2/1989 Casteel et al.
4,840,006 A 6/1989 Humphrey
4,845,920 A 7/1989 Lancaster
4,852,330 A * 8/1989 Carangelo ..... B60P 7/0876 53/399
4,862,678 A 9/1989 Humphrey
4,866,909 A 9/1989 Lancaster, III et al.
4,905,451 A 3/1990 Jaconelli et al.
4,938,008 A 7/1990 Salzsauler
4,953,336 A 9/1990 Lancaster, III et al.
4,955,176 A 9/1990 Seko et al.
4,991,381 A 2/1991 Simons
5,027,579 A 7/1991 Keip
5,040,356 A 8/1991 Thimon
5,040,359 A 8/1991 Thimon
5,054,263 A 10/1991 Maki-Rahkola et al.
5,054,987 A 10/1991 Thornton
5,077,956 A 1/1992 Thimon
5,081,824 A 1/1992 Thimon et al.
5,107,657 A 4/1992 Diehl et al.
5,123,230 A 6/1992 Upmann
5,138,817 A 8/1992 Mowry et al.
5,163,264 A 11/1992 Hannen
5,186,981 A 2/1993 Shellhamer et al.
5,195,296 A 3/1993 Matsumoto
5,195,297 A 3/1993 Lancaster et al.
5,195,301 A 3/1993 Martin-Cocher et al.
5,203,136 A 4/1993 Thimon et al.
5,203,139 A 4/1993 Salsburg et al.
5,203,671 A * 4/1993 Cawley ..... B65B 11/008 414/791.6
5,212,933 A 5/1993 Cere'
5,216,871 A 6/1993 Hannen
5,240,198 A 8/1993 Dorfel
5,301,493 A 4/1994 Chen
5,311,725 A 5/1994 Martin et al.
5,315,809 A 5/1994 Gordon et al.
5,351,461 A * 10/1994 Fandard ..... B65B 11/585 53/157
5,369,416 A 11/1994 Haverty et al.
5,414,979 A 5/1995 Moore et al.
5,421,141 A 6/1995 Gordon
5,447,008 A 9/1995 Martin-Cocher
5,450,711 A 9/1995 Martin-Cocher
5,463,842 A 11/1995 Lancaster
5,524,413 A 6/1996 Fukuda
5,546,730 A 8/1996 Newell et al.
5,572,855 A 11/1996 Reigrut et al.
5,581,979 A 12/1996 Scherer
5,595,042 A 1/1997 Cappi et al.
5,610,344 A 3/1997 Ueda et al.
5,634,321 A 6/1997 Martin-Cocher et al.
5,653,093 A 8/1997 Delledonne
5,671,593 A 9/1997 Ginestra et al.
5,765,344 A 6/1998 Mandeville et al.
5,768,862 A 6/1998 Mauro et al.
5,794,416 A 8/1998 Rahman
5,799,471 A 9/1998 Chen
5,836,140 A 11/1998 Lancaster, III
5,875,617 A 3/1999 Scherer
5,884,453 A 3/1999 Ramsey et al.
5,885,453 A 3/1999 Chatelin et al.
5,893,258 A 4/1999 Lancaster et al.
5,941,049 A 8/1999 Lancaster et al.
5,953,888 A 9/1999 Martin-Cocher et al.
6,082,081 A 7/2000 Mucha
6,170,228 B1 * 1/2001 Zeman, III ..... B65B 11/025 53/168
6,170,233 B1 1/2001 Marois et al.
6,195,968 B1 3/2001 Marois et al.
6,253,532 B1 7/2001 Orpen
6,293,074 B1 9/2001 Lancaster, III et al.
6,314,333 B1 11/2001 Rajala et al.
6,360,512 B1 3/2002 Marois et al.
6,370,839 B1 * 4/2002 Nakagawa ..... B65B 11/008 52/211
6,453,643 B1 9/2002 Buscherini et al.
6,516,591 B1 2/2003 Lancaster, III et al.
6,598,379 B2 7/2003 Zitella
6,684,612 B2 2/2004 Trottet
6,698,161 B1 3/2004 Rossi
6,748,718 B2 6/2004 Lancaster, III et al.
6,826,893 B2 12/2004 Cere'
6,848,237 B2 2/2005 Lancaster, III et al.
6,848,240 B2 2/2005 Frey
6,851,252 B2 2/2005 Maki-Rahkola et al.
6,918,225 B2 7/2005 Ours et al.
6,918,229 B2 7/2005 Lancaster, III et al.
7,040,071 B2 5/2006 Heikaus
7,114,308 B2 10/2006 Cox
7,137,233 B2 11/2006 Degrasse et al.
7,178,317 B1 2/2007 Koskela

(56) References Cited

U.S. PATENT DOCUMENTS 7,386,968 B2 6/2008 Sperry et al.
7,540,128 B2 6/2009 Lancaster, III et al.
7,568,327 B2 8/2009 Lancaster, III et al.
7,707,801 B2 5/2010 Lancaster, III
7,707,901 B2 5/2010 Lancaster, III et al.
7,779,607 B2 8/2010 Lancaster, III et al.
8,001,745 B2 8/2011 Carter et al.
8,037,660 B2 10/2011 Lancaster, III et al.
8,276,346 B2 10/2012 Lancaster, III et al.
8,276,354 B2 10/2012 Lancaster, III et al.
8,424,271 B2 4/2013 Murarotto
8,474,224 B2 7/2013 Rossi
8,539,739 B2 9/2013 Pierson et al.
8,549,819 B1 10/2013 Bison
8,707,644 B2 4/2014 Degen et al.
8,739,502 B2 6/2014 Lancaster, III
8,772,651 B2 * 7/2014 Martin ..... G01C 19/00 177/83
9,488,557 B2 11/2016 Lancaster et al.
9,493,262 B2 11/2016 Lancaster et al.
9,776,748 B2 10/2017 Lancaster et al.
10,676,292 B2 * 6/2020 Saylor ..... B65B 35/22
2001/0015057 A1 8/2001 Suolahti
2002/0029540 A1 3/2002 Lancaster et al.
2003/0089081 A1 5/2003 Platon
2003/0093973 A1 5/2003 Mir
2003/0110737 A1 6/2003 Lancaster et al.
2003/0126833 A1 7/2003 Marchetti
2003/0145563 A1 8/2003 Cere'
2003/0158684 A1 8/2003 Livingston
2003/0200731 A1 10/2003 Maki-Rahkola et al.
2003/0200732 A1 10/2003 Maki-Rahkola et al.
2004/0031238 A1 2/2004 Cox
2004/0040477 A1 3/2004 Neumann
2004/0129150 A1 7/2004 Lancaster et al.
2004/0177592 A1 9/2004 Lancaster et al.
2005/0044812 A1 3/2005 Lancaster et al.
2005/0115202 A1 6/2005 Mertz et al.
2005/0284783 A1 12/2005 May, Jr.
2006/0028969 A1 2/2006 Kondo et al.
2006/0213155 A1 9/2006 Forni et al.
2006/0248858 A1 11/2006 Lancaster
2006/0254214 A1 11/2006 Cox et al.
2006/0254225 A1 11/2006 Lancaster et al.
2006/0289691 A1 12/2006 Forni
2007/0169442 A1 7/2007 Asiold
2007/0204564 A1 9/2007 Lancaster et al.
2007/0204565 A1 9/2007 Lancaster et al.
2007/0209324 A1 9/2007 Lancaster et al.
2008/0066431 A1 * 3/2008 Cousins ..... B65B 11/045 53/465
2008/0078588 A1 4/2008 Draper et al.
2008/0216449 A1 9/2008 Zimmerli
2008/0229707 A1 9/2008 Zitella et al.
2008/0229716 A1 9/2008 Zitella et al.
2008/0295614 A1 12/2008 Lancaster, III et al.
2008/0307754 A1 12/2008 Storig et al.
2009/0178374 A1 * 7/2009 Lancaster, III ..... B65B 57/04 53/441
2009/0235617 A1 9/2009 Moore et al.
2009/0277901 A1 11/2009 Port et al.
2009/0293425 A1 12/2009 Carter et al.
2009/0313942 A1 12/2009 Murarotto
2010/0037562 A1 2/2010 Forni et al.
2010/0064906 A1 3/2010 Rossi
2010/0107653 A1 5/2010 Paskevich et al.
2010/0126119 A1 * 5/2010 Ours ..... B65B 11/00 53/461
2010/0239403 A1 9/2010 Lancaster, III et al.
2010/0300049 A1 12/2010 Schmidt et al.
2010/0303526 A1 12/2010 Hayase
2010/0313525 A1 12/2010 Martin et al.
2010/0320305 A1 12/2010 Lia
2011/0131927 A1 6/2011 Lancaster et al.
2011/0146203 A1 6/2011 Lancaster, III et al.
2011/0168751 A1 7/2011 Tsurumi
2011/0179752 A1 7/2011 Lancaster, III et al.
2012/0031053 A1 2/2012 Lancaster, III et al.
2012/0042615 A1 2/2012 Roche
2012/0102886 A1 5/2012 Lancaster, III et al.
2012/0102887 A1 5/2012 Lancaster et al.
2012/0124944 A1 5/2012 Lancaster, III et al.
2012/0175170 A1 7/2012 Martin et al.
2012/0181368 A1 7/2012 Ekola
2013/0061558 A1 3/2013 Klear et al.
2013/0076753 A1 3/2013 Lancaster, III et al.
2013/0199133 A1 8/2013 Kluge et al.
2013/0247519 A1 * 9/2013 Clark ..... B65B 5/00 53/452
2013/0326999 A1 12/2013 Lemieux et al.
2014/0013707 A1 1/2014 Murarotto
2014/0053502 A1 2/2014 Pecchenini
2014/0109523 A1 4/2014 Nelson
2014/0116006 A1 5/2014 Lancaster et al.
2014/0116007 A1 * 5/2014 Lancaster, III ..... B65B 11/045 53/461
2014/0116008 A1 5/2014 Lancaster et al.
2014/0123605 A1 5/2014 Cere' et al.
2014/0168422 A1 6/2014 Feng et al.
2014/0208696 A1 7/2014 Phillips et al.
2014/0223863 A1 * 8/2014 Lancaster, III ..... B65B 57/04 53/436
2014/0223864 A1 8/2014 Lancaster, III
2014/0331609 A1 11/2014 Bison
2015/0096266 A1 4/2015 Divine et al.
2015/0128530 A1 5/2015 Brunson et al.
2015/0197360 A1 * 7/2015 Lancaster, III ..... B65B 11/025 53/461
2015/0353220 A1 12/2015 Lancaster, III
2016/0096645 A1 4/2016 Lancaster et al.
2016/0096646 A1 4/2016 Lancaster, III
2016/0098171 A1 * 4/2016 Lancaster, III ..... B65B 57/04 715/835
2017/0052075 A1 * 2/2017 Cere ..... G01L 1/20
2017/0088301 A1 * 3/2017 Riemenschneider, III ..... B65B 59/003
2017/0327260 A1 11/2017 Lancaster, III
2018/0022488 A1 1/2018 Lancaster, III
2018/0162660 A1 * 6/2018 Saylor ..... B65B 5/10
2018/0249637 A1 * 9/2018 Kraus ..... B65B 13/22
2018/0273218 A1 9/2018 Lancaster, III et al.
2018/0273226 A1 * 9/2018 Lancaster, III ..... B65B 11/045
2019/0002138 A1 * 1/2019 Laghi ..... B65B 11/025

FOREIGN PATENT DOCUMENTS

CA 2982343 C 8/2019
DE 3140972 A1 6/1982
DE 3119038 A1 12/1982
DE 3100371 A1 2/1988
DE 3634924 A1 4/1988
DE 3901704 A1 8/1990
DE 4234604 A1 4/1994
DE 19509649 A1 9/1996
EP 0096635 A1 12/1983
EP 0144266 A2 6/1985
EP 0246659 A1 11/1987
EP 0466980 A1 1/1992
EP 0653352 A1 5/1995
EP 0671324 A1 9/1995
EP 0811554 A1 12/1997
EP 0842850 A2 5/1998
EP 1083126 A1 3/2001
EP 1125841 A1 8/2001
EP 1213223 A1 6/2002
EP 1489004 A1 12/2004
EP 1650573 A1 4/2006
EP 1650573 A2 4/2006
EP 1705119 A1 9/2006
EP 1717149 A1 11/2006
EP 1736426 A2 12/2006
EP 1807308 A1 7/2007
EP 1736426 A3 10/2007

(56) References Cited

FOREIGN PATENT DOCUMENTS

| | | | |
|---|---|---|---|
| EP | 3353062 | A1 | 8/2018 |
| EP | 3656685 | | 5/2020 |
| EP | 3733533 | | 11/2020 |
| GB | 2059906 | A | 4/1981 |
| GB | 2098569 | A2 | 11/1982 |
| GB | 2107668 | A | 5/1983 |
| GB | 2437359 | A | 10/2007 |
| GN | 1 546 523 | A | 5/1979 |
| JP | S 57166252 | A | 10/1982 |
| JP | S 63191707 | A | 8/1988 |
| JP | H 0385209 | A | 4/1991 |
| JP | H 06239311 | A | 8/1994 |
| JP | H 085448 | A | 1/1996 |
| JP | 09254913 | A | 9/1997 |
| JP | 11165705 | A | 6/1999 |
| JP | 2001048111 | A | 2/2001 |
| JP | 2001072012 | A | 3/2001 |
| JP | 2002211503 | A | 7/2002 |
| JP | 2002362879 | A | 12/2002 |
| JP | 2002362879 | A1 | 12/2002 |
| JP | 2004161344 | A | 6/2004 |
| JP | 3634993 | B2 | 1/2005 |
| JP | 4350940 | B2 | 10/2009 |
| WO | WO 9107341 | A1 | 5/1991 |
| WO | WO 9420367 | A1 | 9/1994 |
| WO | WO 9700202 | A1 | 1/1997 |
| WO | WO 9822346 | A1 | 5/1998 |
| WO | WO9822346 | A1 | 5/1998 |
| WO | WO03020591 | A1 | 3/2003 |
| WO | WO 2004069659 | A1 | 8/2004 |
| WO | WO2006032065 | A1 | 3/2006 |
| WO | WO 2006110596 | A1 | 10/2006 |
| WO | WO 2007071593 | A1 | 6/2007 |
| WO | WO 2007100596 | A2 | 9/2007 |
| WO | WO 2007100597 | A2 | 9/2007 |
| WO | WO 2008007189 | A2 | 1/2008 |
| WO | WO2008049148 | A1 | 5/2008 |
| WO | WO 2008115868 | A1 | 9/2008 |
| WO | WO 2008129432 | A1 | 10/2008 |
| WO | WO 2009047620 | A2 | 4/2009 |
| WO | WO2010130011 | A1 | 11/2010 |
| WO | WO 2011057166 | A2 | 5/2011 |
| WO | WO 2012058549 | A2 | 5/2012 |
| WO | WO 2012058596 | A1 | 5/2012 |
| WO | WO2016057724 | | 4/2016 |
| WO | WO 2017053603 | | 3/2017 |
| WO | WO2017053603 | A1 | 3/2017 |

OTHER PUBLICATIONS

ASTM International (2008). Standard Test Methods for Vibration Testing of Shipping Containers. D999-08. (Year: 2008).

ASTM International (2009). Standard Test Methods for Programmable Horizaontal Impact Test for Shipping Containers and Systems. D4003-98. (Year: 2009).

Blumer, T., & Guadagnini, D. (2011). Shock transmissibility of a palletized load caused by forklift truck handling. Department of Industrial Technology, California Polytechnic State University. (Year:2011).

Cernokus, E. (2012). The Effect of Stretch Wrap Pre-stretch on Unitized Load Containment. M.S. Thesis, Department of Industrial Technology, California Polytechnic State University (Year 2012).

Emblem, A. (2012). Packaging Technology—Fundamentals, Materials and Processed. Woodhead Publishing Ltd. (Year: 2012).

Crocker, Malcolm J. (2007). Handbook of Noise and Vibration Control. John Wiley & Sons. (Year: 2007).

US Patent and Trademark Office, Office Action for U.S. Appl. No. 15/762,513 dated Jan. 21, 2020.

European Patent Office; Office Action in Application No. 16849623.0 dated Feb. 17, 2020.

Canadian Patent Office, Notice of Allowance issued in 2,999,861 dated Sep. 23, 2019.

List of Citations of Related US Patents and/or Patent Applications.

European Patent Office; Extended European Search Report issued in Application No. 16849623.0 dated Apr. 11, 2019.

European Patent Office; Extended European Search Report issued in Application No. 16849620.6 dated Apr. 16, 2019.

Canadian Patent Office; Office Action in Application No. 2,999,860 dated May 1, 2019.

Canadian Patent Office; Office Action in Application No. 2,999,861 dated May 3, 2019.

Australian Patent Office, Notice of Acceptance in Application No. 2016326535 dated Jul. 26, 2019.

Australian Patent Office, Notice of Acceptance in Application No. 2016326540 dated Jul. 12, 2019.

IP Australia, Notice of Grant for Patent for Application No. 2016326535 dated Nov. 21, 2019.

IP Australia, Notice of Grant for Patent for Application No. 2016326540 dated Nov. 7, 2019.

Canadian Patent Office, Office Action for Application No. 2,999,860 dated Aug. 28, 2019.

"The Technology Behind a 'No-Tear', 'No-Rip' Film Carriage, and How to Explain it to your Customers," Jan. 21, 2010, downloaded from http://wulftecstretchwrapper.blogspt.com/2010_01_01archive.html on Jan. 7, 2011; 4 pages.

International Search Report for PCT/US16/53171, dated Dec. 15, 2016.

International Search Report and Written Opinion for PCT/US16/53165, dated Jan. 27, 2017.

European Patent Office; Intention to Grant in Application No. 16849620.6 dated Apr. 8, 2020.

Canadian Patent Office Notice of Allowance for Application No. 2,999,860 dated Apr. 24, 2020.

European Patent Office; Communication in Application No. 20172318.6 dated Nov. 9, 2020.

European Patent Office; Communication in Application No. 20172318.6 dated Oct. 2, 2020.

US Patent and Trademark Office, Notice of Allowance for U.S. Appl. No. 15/762,513 dated Oct. 28, 2020.

US Patent and Trademark Office, Final Office Action for U.S. Appl. No. 15/762,513 dated Jul. 21, 2020.

European Patent Office; Communication in Application No. 20172318.6 dated Mar. 29, 2021.

* cited by examiner

STRETCH WRAPPING MACHINE WITH AUTOMATIC LOAD PROFILING

FIELD OF THE INVENTION

The invention generally relates to wrapping loads with packaging material through relative rotation of loads and a packaging material dispenser.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

A primary metric used in the shipping industry for gauging overall wrapping effectiveness is containment force, which is generally the cumulative force exerted on the load by the packaging material wrapped around the load. Containment force depends on a number of factors, including the number of layers of packaging material, the thickness, strength and other properties of the packaging material, the amount of pre-stretch applied to the packaging material, and the wrap force or tension applied to the load while wrapping the load. An insufficient containment force can lead to undesirable shifting of a wrapped load during later transportation or handling, and may in some instances result in damaged products. On the other hand, due to environmental, cost and weight concerns, an ongoing desire exists to reduce the amount of packaging material used to wrap loads, typically through the use of thinner, and thus relatively weaker packaging materials and/or through the application of fewer layers of packaging material. As such, maintaining adequate containment forces in the presence of such concerns can be a challenge.

One challenge associated with conventional wrapping machines is due to the difficulty in selecting appropriate control parameters to ensure that an adequate containment force is applied to a load. In many wrapping machines, the width of the packaging material is significantly less than the height of the load, and a lift mechanism is used to move an elevator or roll carriage in a direction generally parallel to the axis of rotation of the wrapping machine as the load is being wrapped, which results in the packaging material being wrapped in a generally spiral manner around the load. Conventionally, an operator is able to control a number of wraps around the bottom of the load, a number of wraps around the top of the load, and a speed of the roll carriage as it traverses between the top and bottom of the load to manage the amount of overlap between successive wraps of the packaging material. In some instances, control parameters may also be provided to control an amount of overlap (e.g., in inches) between successive wraps of packaging material.

The control of the roll carriage in this manner, when coupled with the control of the wrap force applied during wrapping, may result in some loads that are wrapped with insufficient containment force throughout, or that consume excessive packaging material (which also has the side effect of increasing the amount of time required to wrap each load). In part, this may be due in some instances to an uneven distribution of packaging material, as it has been found that the overall integrity of a wrapped load is based on the integrity of the weakest portion of the wrapped load. Thus, if the packaging material is wrapped in an uneven fashion around a load such that certain portions of the load have fewer layers of overlapping packaging material and/or packaging material applied with a lower wrap force, the wrapped load may lack the desired integrity regardless of how well it is wrapped in other portions.

Ensuring even and consistent containment force throughout a load, however, has been found to be challenging, particularly for less experienced operators. Traditional control parameters such as wrap force, roll carriage speed, etc. frequently result in significant variances in number of packaging material layers and containment forces applied to loads from top to bottom. Furthermore, many operators lack sufficient knowledge of packaging material characteristics and comparative performance between different brands, thicknesses, materials, etc., so the use of different packaging materials often further complicates the ability to provide even and consistent wrapped loads.

As an example, many operators will react to excessive film breaks by simply reducing wrap force, which leads to inadvertent lowering of cumulative containment forces below desired levels. The effects of insufficient containment forces, however, may not be discovered until much later, when wrapped loads are loaded into trucks, ships, airplanes or trains and subjected to typical transit forces and conditions. Failures of wrapped loads may lead to damaged products during transit, loading and/or unloading, increasing costs as well as inconveniencing customers, manufacturers and shippers alike. Another approach may be to simply lower the speed of a roll carriage and increase the amount of packaging material applied in response to loads being found to lack adequate containment force; however, such an approach may consume an excessive amount of packaging material, thereby increasing costs and decreasing the throughput of a wrapping machine.

In addition, wrapping machines are finding use in connection with more and more applications where the loads to be wrapped differ in some respect from the traditional, cuboid-shaped loads consisting principally of regularly-stacked and substantially rigid cartons of products. Some loads, for example, may include portions or layers, herein referred to as inboard portions, that are substantially inboard of a supporting body upon which they are disposed and to which they must be secured. For example, loads that are palletized using an automated pallet picker may end up with less than complete layers of products on the top layer, and as such the top layer may be substantially inboard from the corners of the main body of the load. In some instances, only one product, or one case of products, may be placed on the top layer of the load. As another example, some loads may have a "ragged" topography due to the inclusion of multiple products or cases of products having varying elevations at different points across the top of the load. As another example, some products loaded onto pallets may be substantially smaller in cross-section than a pallet, and may therefore be substantially inboard from the corners of the pallet. Still other loads may include uncartoned and easily compressible products that may be susceptible to compression or twisting due to excessive wrap force applied during a wrapping operation. Still other loads may include top sheets or slip sheets that are placed on top of a load to protect the top of a load from dust, moisture or damage from another load stacked on top of the load.

Each of these situations places greater demands on a wrapping machine, as well as on an operator of the wrapping machine, to ensure that loads are sufficiently contained. Further, in some situations a wrapping machine may be incapable of adequately wrapping a load regardless of how it is set by an operator.

Therefore, a significant need continues to exist in the art for an improved manner of reliably and efficiently controlling a wrapping machine.

SUMMARY OF THE INVENTION

The invention addresses these and other problems associated with the art by providing a method, apparatus and program product that perform automatic load profiling to optimize a wrapping operation performed with a stretch wrapping machine. Automatic load profiling may be performed, for example, to determine a density parameter for a load that is indicative of load stability such that one or more control parameters may be configured for a wrapping operation based upon the density parameter. Automatic load profiling may also be performed, for example, to detect a load with a nonstandard top layer, e.g., a load with a top or slip sheet, a load with an easily deformable top layer, a load with a ragged top surface topography and/or a load with an inboard portion, such that a top layer containment operation may be activated during wrapping to optimize containment for the load.

Therefore, consistent with one aspect of the invention, a method of controlling a load wrapping apparatus of the type configured to wrap a load on a load support with packaging material dispensed from a packaging material dispenser through relative rotation between the packaging material dispenser and the load support may include sensing a plurality of points on a plurality of surfaces of the load using one or more sensors directed at the load, generating a surface model of the load based upon the sensed plurality of points, where the generated surface model identifies a top surface topography including a plurality of elevations for the load, and controlling one or more control parameters for the load wrapping apparatus when wrapping the load based upon the generated surface model.

In some embodiments, the one or more sensors includes a digital camera, a range imaging sensor or a three-dimensional scanning sensor. Also, in some embodiments, the one or more sensors includes first and second height sensors operatively coupled for substantially vertical movement with the packaging material dispenser and respectively configured to detect elevations for a main body and an inboard portion of the load. In addition, some embodiments may further include determining a density parameter for the load from the generated surface model.

Some embodiments may further include determining a weight parameter for the load, where determining the density parameter includes determining a volume and/or height of the load from the generated surface model and determining the density parameter based upon the determined volume and/or height and the determined weight parameter. Further, in some embodiments, determining the weight parameter includes measuring a weight of the load using a weight sensor.

In some embodiments, determining the volume and/or height of the load includes determining the volume from a length, a width and a height of the load. In addition, in some embodiments, determining the volume from the length, the width and the height of the load includes determining at least one of the length, the width and the height of the load using the generated surface model. In some embodiments, controlling the one or more control parameters for the load wrapping apparatus when wrapping the load based upon the generated surface model includes determining a stability for the load based upon the determined density parameter. In some embodiments, controlling the one or more control parameters for the load wrapping apparatus when wrapping the load based upon the generated surface model includes determining a containment force requirement for the load based upon the determined density parameter. In some embodiments, controlling the one or more control parameters for the load wrapping apparatus when wrapping the load based upon the generated surface model includes determining a wrap force or a number of layers of packaging material to be applied to the load based upon the determined density parameter.

In addition, some embodiments may also include determining whether the load has a nonstandard top layer based upon the generated surface model. In addition, some embodiments may further include determining whether the load has an inboard portion based upon the generated surface model. Some embodiments may also include determining dimensions of the inboard portion of the load based upon the generated surface model.

In some embodiments, controlling the one or more control parameters for the load wrapping apparatus when wrapping the load based upon the generated surface model includes activating a top layer containment operation when wrapping the load based upon determining the load has a nonstandard top layer. In some embodiments, controlling the one or more control parameters for the load wrapping apparatus when wrapping the load based upon the generated surface model further includes selecting the activated top layer containment operation from among a plurality of top layer containment operations based upon the generated surface model.

In some embodiments, the plurality of top layer containment operations includes a cross wrap containment operation and a U wrap containment operation, and in some embodiments, selecting the activated top layer containment operation from among the plurality of top layer containment operations includes selecting between the cross wrap containment operation and the U wrap containment operation based upon at least one dimension of an inboard portion of the load determined from the generated surface model.

In addition, in some embodiments controlling the one or more control parameters for the load wrapping apparatus when wrapping the load based upon the generated surface model further includes controlling one or more control parameters for the top layer containment operation based upon the generated surface model. In addition, in some embodiments, controlling the one or more control parameters for the top layer containment operation includes controlling one or more of an elevation of a web of packaging material, a width of the web of packaging material, an elevation of an elevator of a packaging material dispenser, a speed of the elevator, an activation state of a roping mechanism, an elevation change start time, an elevation change start angle, or a top edge contact point based upon the generated surface model.

Some embodiments may further include determining a verticality of at least one side of the load based upon the generated surface model. Also, in some embodiments, controlling the one or more control parameters for the load wrapping apparatus when wrapping the load based upon the generated surface model includes selecting or configuring a wrap profile for the load based upon the generated surface model.

Consistent with another aspect of the invention, a method of controlling a load wrapping apparatus of the type configured to wrap a load on a load support with packaging material dispensed from a packaging material dispenser through relative rotation between the packaging material dispenser and the load support may include determining a density parameter for the load prior to wrapping the load, and controlling one or more control parameters for the load wrapping apparatus when wrapping the load based upon the determined density parameter for the load.

Some embodiments may also include determining a weight parameter and a volume and/or height of the load, where determining the density parameter includes determining the density parameter from the weight parameter and the volume and/or height of the load. In addition, in some embodiments, determining the weight parameter of the load includes measuring a weight of the load using a weight sensor.

Also, in some embodiments, determining the volume and/or height of the load includes determining the volume from a length, a width and a height of the load. Moreover, in some embodiments, the load includes an inboard portion, and determining the volume from the length, the width and the height of the load includes determining the volume from a plurality of lengths, widths and heights of the load.

Some embodiments may further include sensing a plurality of points on a plurality of surfaces of the load using one or more sensors directed at the load and generating a surface model of the load based upon the sensed plurality of points, where the generated surface model identifies a top surface topography including a plurality of elevations for the load, and where determining the volume includes determining the volume based upon the generated surface model.

Consistent with another aspect of the invention, a method of controlling a load wrapping apparatus of the type configured to wrap a load on a load support with packaging material dispensed from a packaging material dispenser through relative rotation between the packaging material dispenser and the load support may include sensing a plurality of points on a plurality of surfaces of the load using one or more sensors directed at the load, determining whether the load has a nonstandard top layer based upon the sensed plurality of points, and selectively controlling the load wrapping apparatus to perform a top layer containment operation on the load during wrapping of the load based upon determining that the load has a nonstandard top layer.

Also, in some embodiments, determining whether the load has a nonstandard top layer includes determining whether the load includes an inboard portion. Also, in some embodiments, selectively controlling the load wrapping apparatus to perform the top layer containment operation includes selecting the top layer containment operation from among a plurality of top layer containment operations. Further, in some embodiments, the plurality of top layer containment operations includes a cross wrap containment operation and a U wrap containment operation. Further, in some embodiments, selecting the top layer containment operation from among the plurality of top layer containment operations includes selecting between the cross wrap containment operation and the U wrap containment operation based upon at least one dimension of the inboard portion of the load.

In some embodiments, selecting between the cross wrap containment operation and the U wrap containment operation is based upon a thickness of the inboard portion of the load. In addition, in some embodiments, selectively controlling the load wrapping apparatus to perform the top layer containment operation includes controlling one or more control parameters for the top layer containment operation based upon the sensed plurality of points.

Also, in some embodiments, controlling the one or more control parameters for the top layer containment operation includes controlling one or more of an elevation of a web of packaging material, a width of the web of packaging material, an elevation of an elevator of a packaging material dispenser, a speed of the elevator, an activation state of a roping mechanism, an elevation change start time, an elevation change start angle, or a top edge contact point based upon the sensed plurality of points. Some embodiments may also include generating a surface model of the load based upon the sensed plurality of points, where the generated surface model identifies a top surface topography including a plurality of elevations for the load, and where determining whether the load has a nonstandard top layer is based upon the generated surface model.

Consistent with yet another aspect of the invention, a method of controlling a load wrapping apparatus of the type configured to wrap a load on a load support with packaging material dispensed from a packaging material dispenser through relative rotation between the packaging material dispenser and the load support may include sensing whether the load includes an inboard portion using at least one sensor directed at the load, and in response to sensing that the load includes an inboard portion, automatically activating a top layer containment operation during wrapping of the load to secure the inboard portion to a supporting body of the load.

In some embodiments, sensing whether the load includes the inboard portion includes sensing an elevation of the inboard portion that is different from an elevation of the supporting body. Further, in some embodiments, activating the top layer containment operation includes performing a cross wrap containment operation or a U wrap containment operation. Some embodiments may further include, in response to sensing that the load includes the inboard portion, selecting the top layer containment operation from among a plurality of top layer containment operations. In some embodiments, the plurality of top layer containment operations includes a cross wrap containment operation and a U wrap containment operation, and where selecting the top layer containment operation from among the plurality of top layer containment operations includes selecting between the cross wrap containment operation and the U wrap containment operation based upon a sensed elevation of the inboard portion of the load relative to that of the supporting body.

Consistent with another aspect of the invention, a method of controlling a load wrapping apparatus of the type configured to wrap a load on a load support with packaging material dispensed from a packaging material dispenser through relative rotation between the packaging material dispenser and the load support may include sensing a plurality of points on a plurality of surfaces of the load using one or more sensors directed at the load, determining at least one dimension of the load from the sensed plurality of points, determining a weight parameter for the load, determining a wrap force control parameter and a minimum layer control parameter based upon the determined at least one dimension and the determined weight parameter, and controlling the load wrapping apparatus when wrapping the load using the determined wrap force and minimum layer control parameters.

Some embodiments may further include sensing a weight of the load, where determining the weight parameter includes determining the weight parameter based upon the sensed weight. Also, in some embodiments, sensing the plurality of points and sensing the weight are performed during conveying of the load to the wrapping apparatus. In addition, in some embodiments, sensing the plurality of points is performed by a distance sensor disposed overhead of a conveyor, and sensing the weight is performed by a load cell coupled to the conveyor. In some embodiments, determining the wrap force control parameter and the minimum layer control parameter based upon the determined at least one dimension and the determined weight parameter includes one or more of a containment force requirement for the load, a stability for the load or a density parameter for the load.

Some embodiments may also include detecting an inboard load from the sensed plurality of points, and activating an inboard load containment operation when wrapping the load in response to detecting the inboard load. In addition, in some embodiments, the inboard load containment operation reduces the wrap force control parameter when wrapping around a pallet. In addition, some embodiments may further include detecting a degree to which the load is inboard of the pallet, where activating the inboard load containment operation includes activating an inboard load containment operation that reduces the wrap force control parameter when wrapping around a pallet and that applies an additional band of packaging material around the load above the pallet in response to the detected degree. In addition, some embodiments may also include detecting an irregular load from the sensed plurality of points, and reducing the wrap force control parameter in response to detecting the irregular load.

In addition, some embodiments may also include automatically increasing the minimum layer control parameter in response to reducing the wrap force control parameter in order to maintain a containment force requirement for the load. Some embodiments may also include determining whether the load has a nonstandard top layer based upon the sensed plurality of points, and activating a top layer containment operation when wrapping the load in response to determining that the load has a nonstandard top layer.

Some embodiments may also include an apparatus for wrapping a load with packaging material and including a packaging material dispenser configured to dispense packaging material to the load, a drive mechanism configured to provide relative rotation between the packaging material dispenser and the load about an axis of rotation, and a controller configured to perform any of the aforementioned methods. In addition, some embodiments may also include a non-transitory computer readable medium and program code stored on the non-transitory computer readable medium and configured to control a load wrapping apparatus of the type configured to wrap a load with packaging material dispensed from a packaging material dispenser through relative rotation between the packaging material dispenser and the load, where the program code is configured to control the load wrapping apparatus by performing any of the aforementioned methods.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention.

DETAILED DESCRIPTION

Embodiments consistent with the invention perform automatic load profiling to optimize a wrapping operation performed with a stretch wrapping machine. Automatic load profiling may be performed, for example, to determine a density parameter for a load that is indicative of load stability such that one or more control parameters may be configured for a wrapping operation based upon the density parameter. Automatic load profiling may also be performed, for example, to detect a load with a nonstandard top layer, e.g., a load with a top or slip sheet, a load with an easily deformable top layer, a load with a ragged top surface topography and/or a load with an inboard portion, such that a top layer containment operation may be activated during wrapping to optimize containment for the load. Prior to a further discussion of these various techniques, however, a brief discussion of various types of wrapping apparatus within which the various techniques disclosed herein may be implemented is provided.

Wrapping Apparatus Configurations

Figure 1:
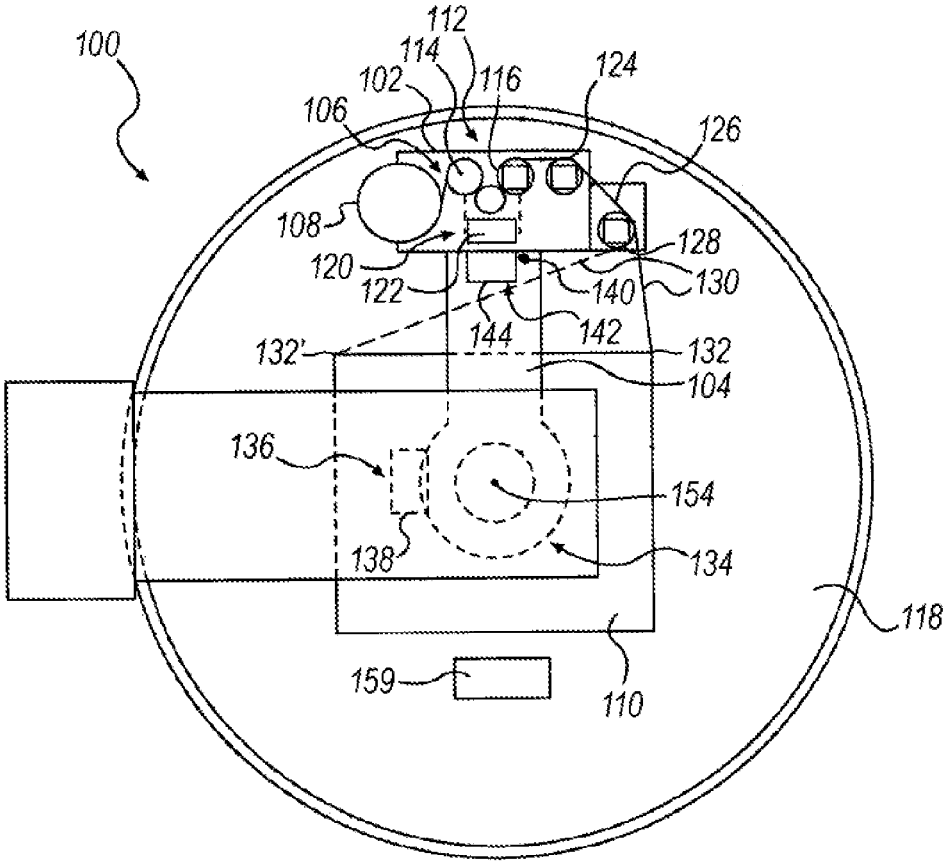
FIG. 1 shows a top view of a rotating arm-type wrapping apparatus consistent with the invention.

Various wrapping apparatus configurations may be used in various embodiments of the invention. For example, FIG. 1 illustrates a rotating arm-type wrapping apparatus 100, which includes a roll carriage or elevator 102 mounted on a rotating arm 104. Roll carriage 102 may include a packaging material dispenser 106. Packaging material dispenser 106 may be configured to dispense packaging material 108 as rotating arm 104 rotates relative to a load 110 to be wrapped. In an example embodiment, packaging material dispenser 106 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, tape, etc. The invention is therefore not limited to use with stretch wrap packaging material. In addition, as used herein, the terms "packaging material," "web," "film," "film web," and "packaging material web" may be used interchangeably.

Packaging material dispenser 106 may include a pre-stretch assembly 112 configured to pre-stretch packaging material before it is applied to load 110 if pre-stretching is desired, or to dispense packaging material to load 110 without pre-stretching. Pre-stretch assembly 112 may include at least one packaging material dispensing roller, including, for example, an upstream dispensing roller 114 and a downstream dispensing roller 116. It is contemplated that pre-stretch assembly 112 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 108 as it moves from packaging material dispenser 106 to load 110. Movement of an object toward packaging material dispenser 106, away from load 110, and thus, against the direction of flow of packaging material 108, may be defined as "upstream." Similarly, movement of an object away from packaging material dispenser 106, toward load 110, and thus, with the flow of packaging material 108, may be defined as "downstream." Also, positions relative to load 110 (or a load support surface 118) and packaging material dispenser 106 may be described relative to the direction of packaging material flow. For example, when two pre-stretch rollers are present, the pre-stretch roller closer to packaging material dispenser 106 may be characterized as the "upstream" roller and the pre-stretch roller closer to load 110 (or load support 118) and further from packaging material dispenser 106 may be characterized as the "downstream" roller.

A packaging material drive system 120, including, for example, an electric motor 122, may be used to drive dispensing rollers 114 and 116. For example, electric motor 122 may rotate downstream dispensing roller 116. Downstream dispensing roller 116 may be operatively coupled to upstream dispensing roller 114 by a chain and sprocket assembly, such that upstream dispensing roller 114 may be driven in rotation by downstream dispensing roller 116. Other connections may be used to drive upstream roller 114 or, alternatively, a separate drive (not shown) may be provided to drive upstream roller 114.

Downstream of downstream dispensing roller 116 may be provided one or more idle rollers 124, 126 that redirect the web of packaging material, with the most downstream idle roller 126 effectively providing an exit point 128 from packaging material dispenser 102, such that a portion 130 of packaging material 108 extends between exit point 128 and a contact point 132 where the packaging material engages load 110 (or alternatively contact point 132' if load 110 is rotated in a counter-clockwise direction).

Wrapping apparatus 100 also includes a relative rotation assembly 134 configured to rotate rotating arm 104, and thus, packaging material dispenser 106 mounted thereon, relative to load 110 as load 110 is supported on load support surface 118. Relative rotation assembly 134 may include a rotational drive system 136, including, for example, an electric motor 138. It is contemplated that rotational drive system 136 and packaging material drive system 120 may run independently of one another. Thus, rotation of dispensing rollers 114 and 116 may be independent of the relative rotation of packaging material dispenser 106 relative to load 110. This independence allows a length of packaging material 108 to be dispensed per a portion of relative revolution that is neither predetermined nor constant. Rather, the length may be adjusted periodically or continuously based on changing conditions. In other embodiments, however, packaging material dispenser 106 may be driven proportionally to the relative rotation, or alternatively, tension in the packaging material extending between the packaging material dispenser and the load may be used to drive the packaging material dispenser.

Wrapping apparatus 100 may further include a lift assembly 140. Lift assembly 140 may be powered by a lift drive system 142, including, for example, an electric motor 144, that may be configured to move roll carriage 102 vertically relative to load 110. Lift drive system 142 may drive roll carriage 102, and thus packaging material dispenser 106, generally in a direction parallel to an axis of rotation between the packaging material dispenser 106 and load 110 and load support surface 118. For example, for wrapping apparatus 100, lift drive system 142 may drive roll carriage 102 and packaging material dispenser 106 upwards and downwards vertically on rotating arm 104 while roll carriage 102 and packaging material dispenser 106 are rotated about load 110 by rotational drive system 136, to wrap packaging material spirally about load 110.

In some embodiments, one or more of downstream dispensing roller 116, idle roller 124 and idle roller 126 may include a sensor to monitor rotation of the respective roller. In addition, in some embodiments, wrapping apparatus may also include an angle sensor for determining an angular relationship between load 110 and packaging material dispenser 106 about a center of rotation 154. In other embodiments, an angular relationship may be represented and/or measured in units of time, based upon a known rotational speed of the load relative to the packaging material dispenser, from which a time to complete a full revolution may be derived such that segments of the revolution time would correspond to particular angular relationships. Other sensors may also be used to determine the height and/or other dimensions of a load, among other information.

Wrapping apparatus 100 may also include additional components used in connection with other aspects of a wrapping operation. For example, a clamping device 159 may be used to grip the leading end of packaging material 108 between cycles. In addition, a conveyor (not shown) may be used to convey loads to and from wrapping apparatus 100. Other components commonly used on a wrapping apparatus will be appreciated by one of ordinary skill in the art having the benefit of the instant disclosure.

Figure 2:
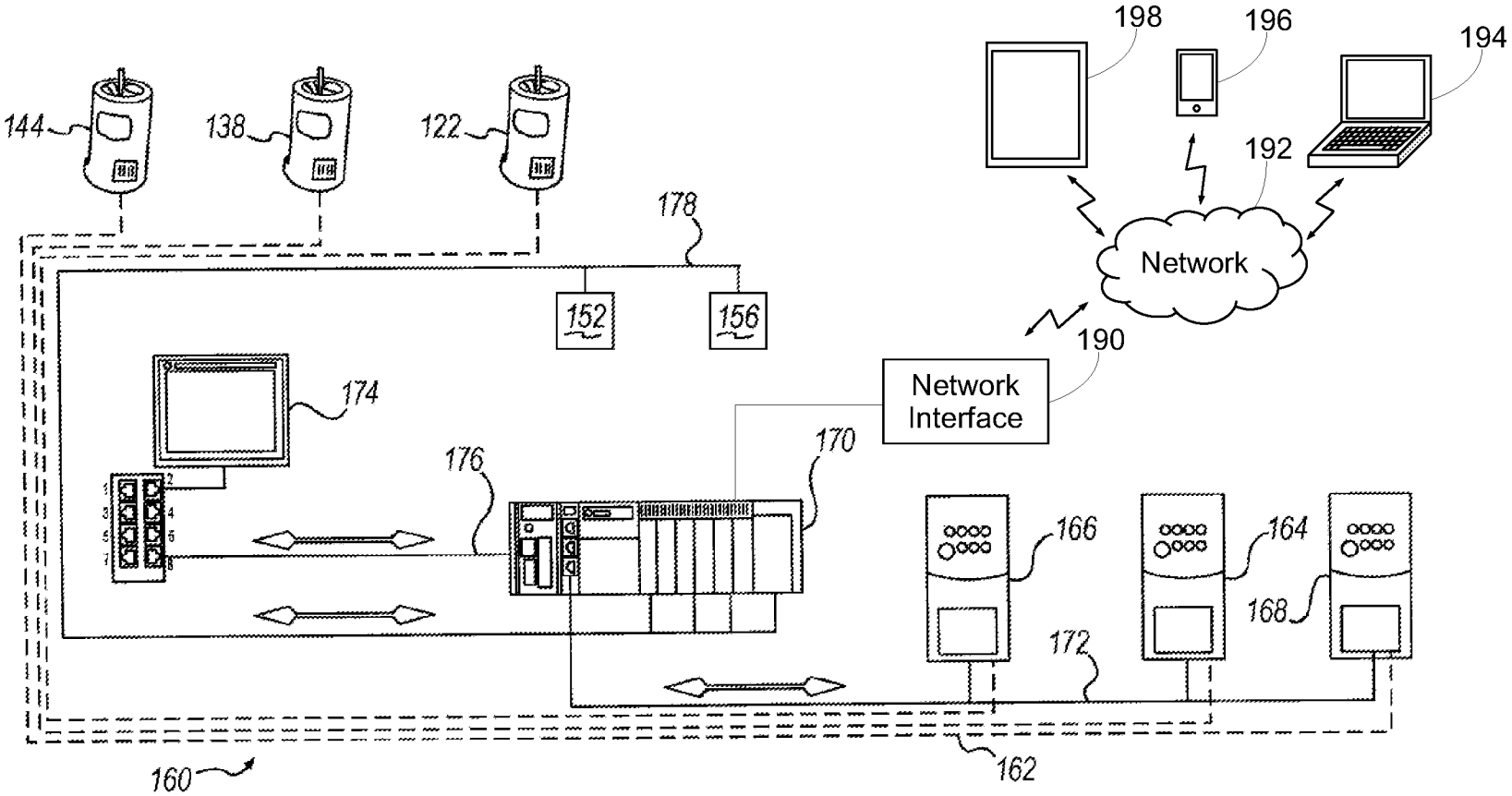
FIG. 2 is a schematic view of an example control system for use in the apparatus of FIG. 1.

An example schematic of a control system 160 for wrapping apparatus 100 is shown in FIG. 2. Motor 122 of packaging material drive system 120, motor 138 of rotational drive system 136, and motor 144 of lift drive system 142 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement.

Controller 170 in the embodiment illustrated in FIG. 2 is a local controller that is physically co-located with the packaging material drive system 120, rotational drive system 136 and lift drive system 142. Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors, e.g., sensors 152 and 156, among others, through a data link 178 to allow controller 170 to receive feedback and/or performance-related data during wrapping, such as roller and/or drive rotation speeds, load dimensional data, etc. It is contemplated that data links 162, 172, 176, and 178 may include any suitable wired and/or wireless communications media known in the art.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to the various drive systems 120, 136 and 142 of wrapping apparatus 100.

Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor in CPU 52, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 170 may include an interface 190 with one or more networks 192 (e.g., a LAN, a WAN, a wireless network, and/or the Internet, among others) to permit the communication of information to the components in wrapping apparatus 100 as well as with other computers and electronic devices, e.g. computers such as a desktop computer or laptop computer 194, mobile devices such as a mobile phone 196 or tablet 198, multi-user computers such as servers or cloud resources, etc. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 100 is assumed to be incorporated wholly within components that are local to wrapping apparatus 100 illustrated in FIGS. 1-2, e.g., within components 162-178 described above. It will be appreciated, however, that in other embodiments, at least a portion of the functionality incorporated into a wrapping apparatus may be implemented in hardware and/or software that is external to the aforementioned components. For example, in some embodiments, some user interaction may be performed using a networked computer or mobile device, with the networked computer or mobile device converting user input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user input, converting the user input into control variables for controlling a wrap operation, initiating and implementing a wrap operation based upon the control variables, providing feedback to a user, etc., may be implemented by various local and/or remote components and combinations thereof in different embodiments. As such, the invention is not limited to the particular allocation of functionality described herein.

Figure 3:
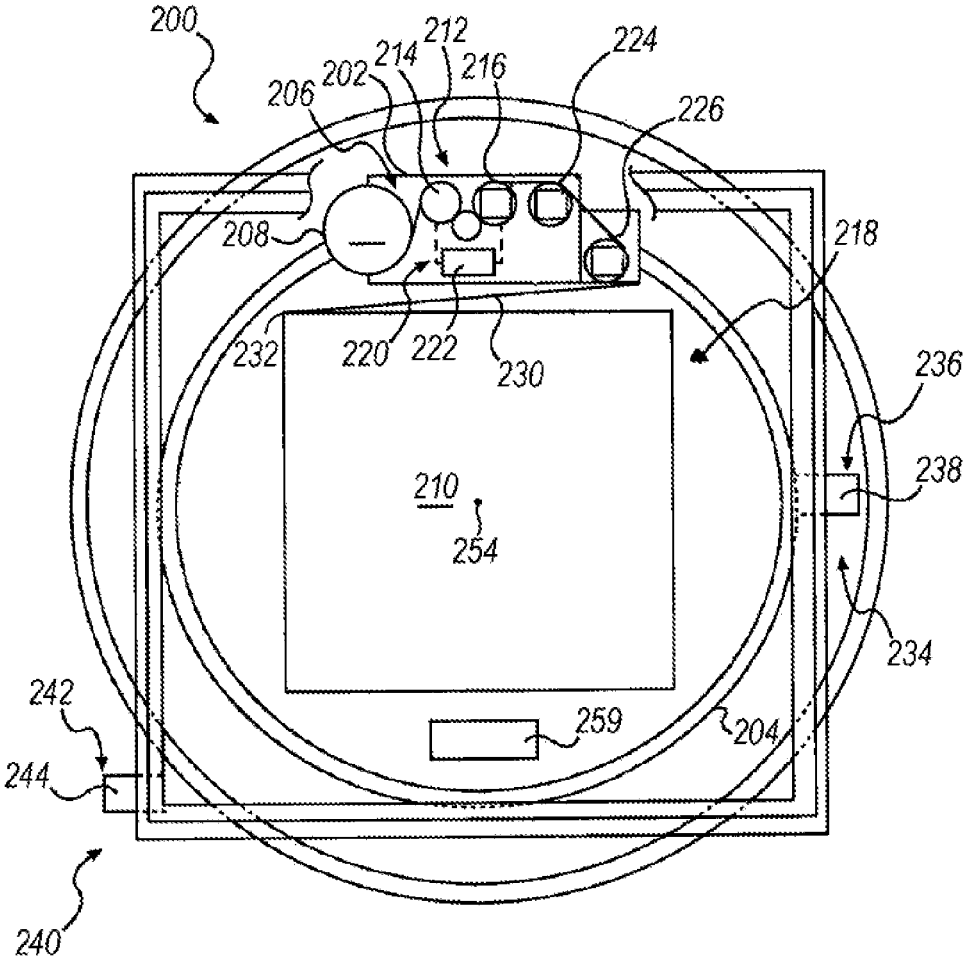
FIG. 3 shows a top view of a rotating ring-type wrapping apparatus consistent with the invention.

Now turning to FIG. 3, a rotating ring-type wrapping apparatus 200 is illustrated. Wrapping apparatus 200 may include elements similar to those shown in relation to wrapping apparatus 100 of FIG. 1, including, for example, a roll carriage or elevator 202 including a packaging material dispenser 206 configured to dispense packaging material 208 during relative rotation between roll carriage 202 and a load 210 disposed on a load support 218. However, a rotating ring 204 is used in wrapping apparatus 200 in place of rotating arm 104 of wrapping apparatus 100. In many other respects, however, wrapping apparatus 200 may operate in a manner similar to that described above with respect to wrapping apparatus 100.

Packaging material dispenser 206 may include a pre-stretch assembly 212 including an upstream dispensing roller 214 and a downstream dispensing roller 216, and a packaging material drive system 220, including, for example, an electric motor 222, may be used to drive dispensing rollers 214 and 216. Downstream of downstream dispensing roller 216 may be provided one or more idle rollers 224, 226, with the most downstream idle roller 226 effectively providing an exit point 228 from packaging material dispenser 206, such that a portion 230 of packaging material 208 extends between exit point 228 and a contact point 232 where the packaging material engages load 210.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210. In addition, similar to wrapping apparatus 100, wrapping apparatus 200 may include various sensors, as well as additional components used in connection with other aspects of a wrapping operation, e.g., a clamping device 259 may be used to grip the leading end of packaging material 208 between cycles.

Figure 4:
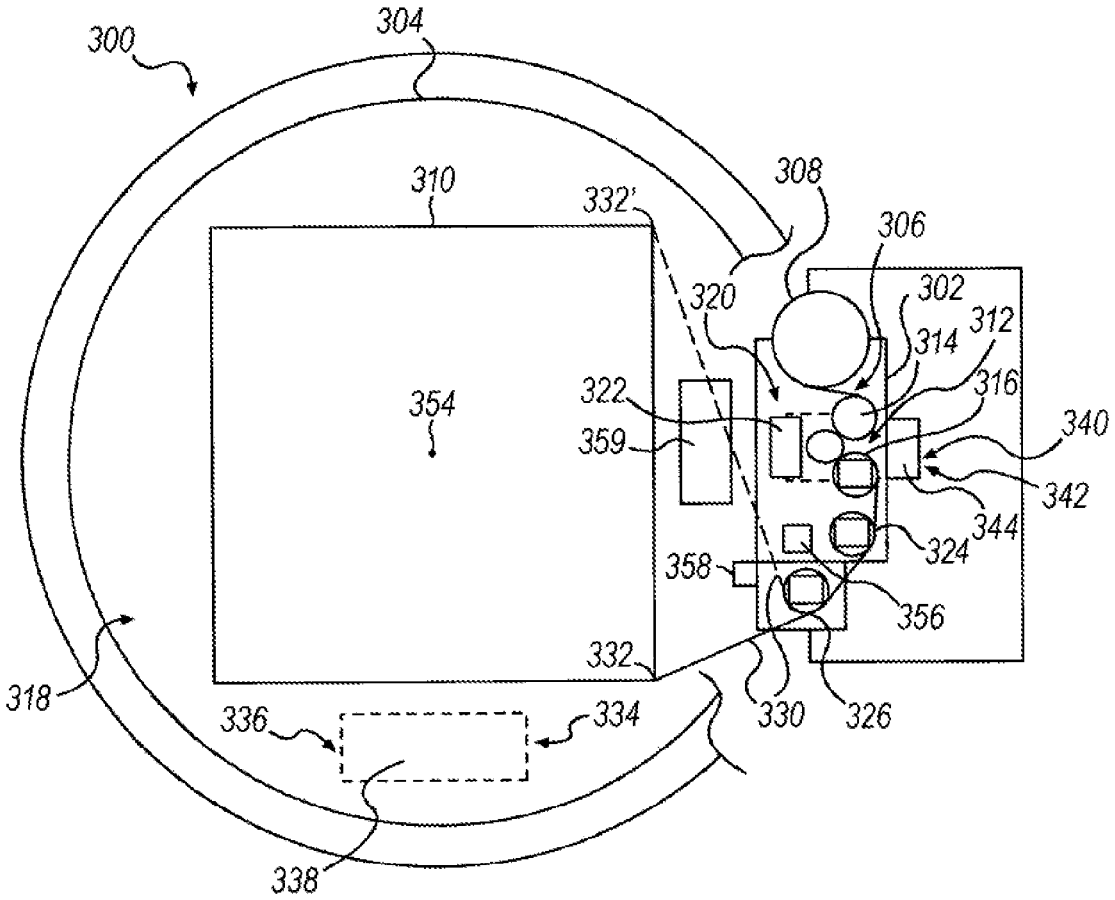
FIG. 4 shows a top view of a turntable-type wrapping apparatus consistent with the invention.

FIG. 4 likewise shows a turntable-type wrapping apparatus 300, which may also include elements similar to those shown in relation to wrapping apparatus 100 of FIG. 1. However, instead of a roll carriage or elevator 102 that rotates around a fixed load 110 using a rotating arm 104, as in FIG. 1, wrapping apparatus 300 includes a rotating turntable 304 functioning as a load support 318 and configured to rotate load 310 about a center of rotation 354 (through which projects an axis of rotation that is perpendicular to the view illustrated in FIG. 4) while a packaging material dispenser 306 disposed on a roll carriage or elevator 302 remains in a fixed location about center of rotation 354 while dispensing packaging material 308. In many other respects, however, wrapping apparatus 300 may operate in a manner similar to that described above with respect to wrapping apparatus 100.

Packaging material dispenser 306 may include a pre-stretch assembly 312 including an upstream dispensing roller 314 and a downstream dispensing roller 316, and a packaging material drive system 320, including, for example, an electric motor 322, may be used to drive dispensing rollers 314 and 316, and downstream of downstream dispensing roller 316 may be provided one or more idle rollers 324, 326, with the most downstream idle roller 326 effectively providing an exit point 328 from packaging material dispenser 306, such that a portion 330 of packaging material 308 extends between exit point 328 and a contact point 332 (or alternatively contact point 332' if load 310 is rotated in a counter-clockwise direction) where the packaging material engages load 310.

Wrapping apparatus 300 also includes a relative rotation assembly 334 configured to rotate turntable 304, and thus, load 310 supported thereon, relative to packaging material dispenser 306. Relative rotation assembly 334 may include a rotational drive system 336, including, for example, an electric motor 338. Wrapping apparatus 300 may further include a lift assembly 340, which may be powered by a lift drive system 342, including, for example, an electric motor 344, that may be configured to move roll carriage or elevator 302 and packaging material dispenser 306 vertically relative to load 310. In addition, similar to wrapping apparatus 100, wrapping apparatus 300 may include various sensors, as well as additional components used in connection with other aspects of a wrapping operation, e.g., a clamping device 359 may be used to grip the leading end of packaging material 308 between cycles.

Each of wrapping apparatus 200 of FIG. 3 and wrapping apparatus 300 of FIG. 4 may also include a controller (not shown) similar to controller 170 of FIG. 2, and receive signals from one or more of the aforementioned sensors and control packaging material drive system 220, 320 during relative rotation between load 210, 310 and packaging material dispenser 206, 306.

Those skilled in the art will recognize that the example environments illustrated in FIGS. 1-4 are not intended to limit the present invention. Indeed, those skilled in the art will recognize that other alternative environments may be used without departing from the scope of the invention.

Wrapping Operations

During a typical wrapping operation, a clamping device, e.g., as known in the art, is used to position a leading edge of the packaging material on the load such that when relative rotation between the load and the packaging material dispenser is initiated, the packaging material will be dispensed from the packaging material dispenser and wrapped around the load. In addition, where prestretching is used, the packaging material is stretched prior to being conveyed to the load. During a main portion of a wrapping cycle, the dispense rate of the packaging material is controlled during the relative rotation between the load and the packaging material, and a lift assembly controls the position, e.g., the height or elevation, of the web of packaging material engaging the load so that the packaging material is wrapped in a spiral manner around the sides of the load from the base or bottom of the load to the top. Multiple layers of packaging material may be wrapped around the load over multiple passes to increase overall containment force, and once the desired amount of packaging material is dispensed, the packaging material is severed to complete the wrap.

Figure 5:
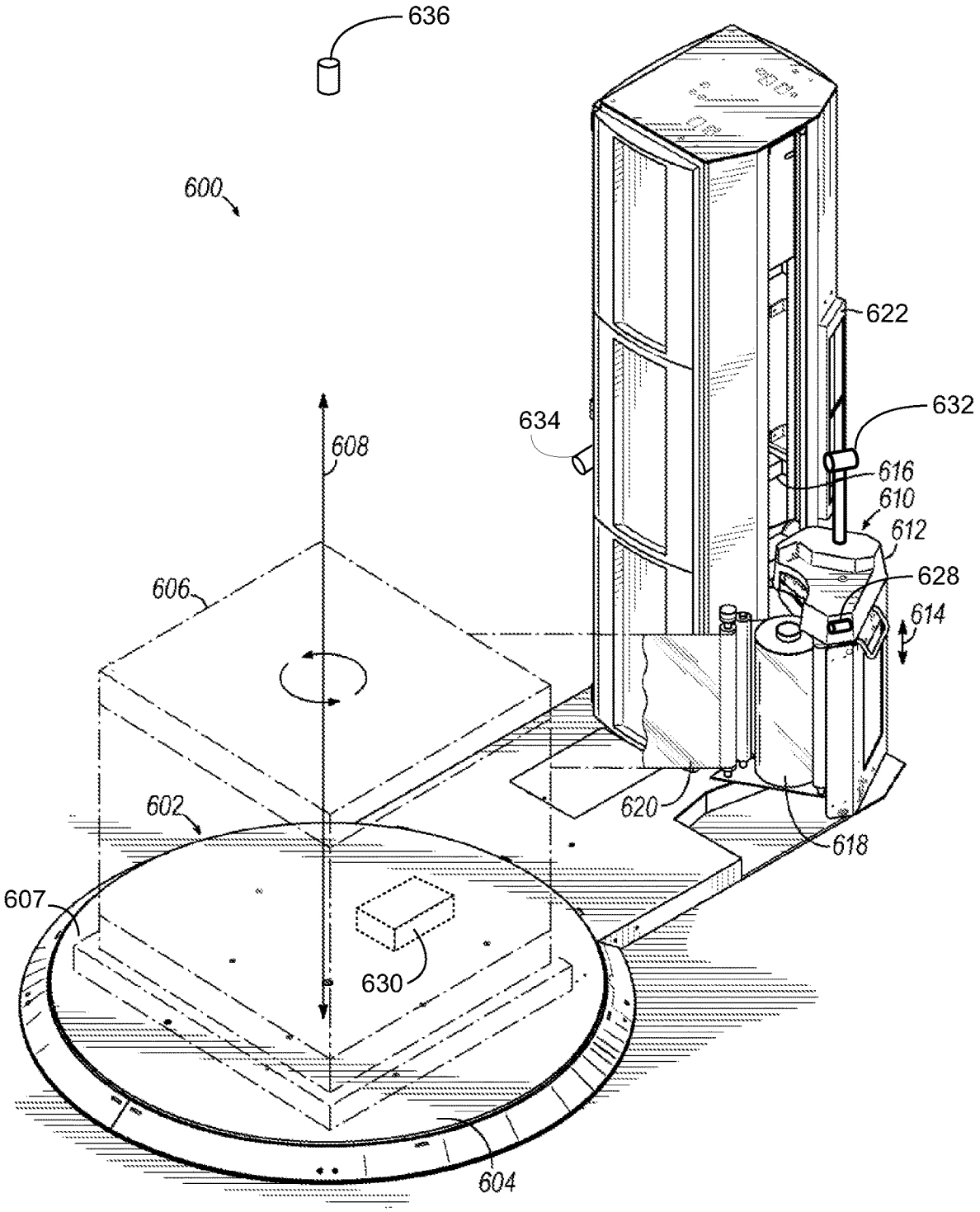
FIG. 5 is a perspective view of a turntable-type wrapping apparatus consistent with the invention, and illustrating various sensor configurations for use in performing automatic load profiling.

In addition, as noted above, during a wrapping operation, the position of the web of packaging material may be controlled to wrap the load in a spiral manner. FIG. 5, for example, illustrates a turntable-type wrapping apparatus 600 similar to wrapping apparatus 300 of FIG. 4, including a load support 602 configured as a rotating turntable 604 for supporting a load 606 disposed on a pallet 607. Turntable 604 rotates about an axis of rotation 608, e.g., in a counter-clockwise direction as shown in FIG. 5.

A packaging material dispenser 610 is mounted to a roll carriage or elevator 612 that is configured for movement along an axis 614 by a lift mechanism 616. Packaging material dispenser 610 supports a roll 618 of packaging material, which during a wrapping operation includes a web 620 extending between packaging material dispenser 610 and load 606.

Axis 614 is generally parallel to an axis about which packaging material is wrapped around load 606, e.g., axis 608, and movement of elevator 612, and thus web 620, along axis 614 during a wrapping operation enables packaging material to be wrapped spirally around the load. It will be appreciated, however, that axis 614 need not be parallel to axis 608 in some embodiments, and in such embodiments, a change in elevation of web 620 parallel to axis 608 may represent only a component of the movement of elevator 612 along axis 614 that is parallel to axis 608. It will be appreciated that a roll carriage or elevator, in this regard, may be considered to include any structure on a wrapping machine (e.g., a turntable-type, rotating ring-type or rotating arm-type) that is capable of controllably changing the elevation of a packaging material dispenser coupled thereto, and thereby effectively changing the elevation of a web of packaging material dispensed by the packaging material dispenser.

The position of packaging material dispenser 610 may be sensed using a sensing device (not shown in FIG. 5), which may include any suitable reader, encoder, transducer, detector, or sensor capable of determining the position of the elevator, another portion of the packaging material dispenser, or of the web of packaging material itself relative to load 606 along axis 614. It will be appreciated that while a vertical axis 614 is illustrated in FIG. 5, and thus the position of elevator 612 corresponds to a height, in other embodiments, e.g., where a load is wrapped about an axis other than a vertical axis, the position of the elevator may not be perfectly related to a height. In addition, the height of the load may be sensed using a sensing device 628, e.g., a photoelectric sensor.

Moreover, in the illustrated embodiments discussed hereinafter, axis 608 is vertically oriented such that elevator 612 moves substantially vertically in a direction corresponding to a height dimension of the load. In some embodiments, however, such as in connection with a horizontal ring-type wrapping apparatus, the axis of rotation may not be vertically oriented. As such, while reference may be made hereinafter to directions or positions such as "top," "bottom," "up," "down," "elevation," etc., one of ordinary skill in the art will appreciate that such nomenclature is used merely for convenience, and the invention is not limited to use with a vertical axis of rotation.

Control of the position of elevator 612, as well as of the other drive systems in wrapping apparatus 600, is provided by a controller 622, the details of which are discussed in further detail below.

Load Profile

As will become more apparent below, automatic load profiling in the illustrated embodiments may be used to generate a load profile for a load, generally representing a collection of properties of the load that may be utilized in the control of a stretch wrapping machine to wrap the load. In addition, in some embodiments, a load profile may be configured as a data structure and may be stored in a database or other suitable storage, and may be created using a controller or computer system, imported from an external system, exported to an external system, retrieved from a storage device, etc. In other embodiments, however, a load profile may simply be a collection of properties for a load collected prior to a wrapping operation performed on the load using one or more of upstream sensor data, sensor data collected at a wrapping location prior to and/or during a wrapping operation, data retrieved from a database or external source or data input by an operator, and in some embodiments, the collected properties may be discarded after the load is wrapped.

The properties that may be incorporated into a load profile may vary in different embodiments, and sensor inputs from a number of different types of sensors may be used in order to determine a number of different types of properties of a load for inclusion in a load profile. In particular, a load profile may include various load dimensions such as overall height or elevation, length and/or width for a load, as well as dimensions of different portions of a load, e.g., of a main body, an inboard portion, an inboard product, a pallet, etc. Further, in some embodiments, dimensions of individual products, cartons, packages, etc. may also be included in a load profile. The dimensions may be based upon distances along regular Cartesian axes, e.g., heights or elevations, widths, lengths in the case of cuboid-shaped loads or load portions, as well as based on other distances as may be appropriate for non-cuboid-shaped loads or load portions, e.g., circumferences, perimeters, diameters, chord lengths, etc. In addition, in some embodiments, the determination of various dimensions of a load may be based upon sensing the locations of one or more surfaces of a load in a three-dimensional space, e.g., by sensing the locations of one or more points on such surfaces, and as such, in some embodiments, a load profile may include locations of one or more points, surfaces, edges, corners, etc. of a load. Still further, dimensions may be represented as relative dimensions (e.g., "short", "normal", "long", etc.), and dimensions may also be determined as averages, medians, etc. of multiple data points.

Further, in some embodiments a load profile may include a surface model for the load. A surface model, in this regard, may be considered to include a collection of data that models one or more surfaces of the load. A surface may be modeled, for example, using one or more points defining the surface, by one or more dimensions defining the surface, etc.

Further, in some embodiments, a surface model may identify a top surface topography that may be used, for example, to identify various irregular aspects of a particular load. A top surface topography may, for example, define a plurality of elevations for the load, generally taken at a plurality of locations on one or more top surfaces defined on the load. As an example, assuming a substantially vertical axis of rotation and a Cartesian (x, y, z) coordinate system, height or elevation may be defined along the z-axis, and the plurality of locations may be defined with different coordinates along the x and y axes. The height or elevation may be taken relative to various planes that are perpendicular to the axis of rotation, e.g., a floor, a load support upon which a load has been placed, a top of a pallet, a predetermined reference elevation on the load (e.g., a top surface of a main body), or even a reference elevation located at a higher elevation than the load (e.g., the position of an overhead sensor).

As will become more apparent below, a surface model may be used, for example, to define an inboard portion of a load or a ragged topography for a top surface of a load. As such, a surface model in some embodiments may include data such as values representing respective heights/elevations for a main body, an inboard portion, a pallet, etc., or values representing maximum, minimum, average or median heights/elevations therefor. In some embodiments, however, a surface model may include additional data, e.g., heights/elevations at a plurality of locations or surface definitions derived from such points.

In some embodiments, surfaces modeled by a surface model may be assumed to be substantially perpendicular to an axis of rotation, and as such, may be identified simply using a single height or elevation. Thus, for example, a surface model in one embodiment may identify a height or elevation of an inboard load to effectively define a top surface of the inboard portion of a load, along with a height or elevation of a supporting body of a load to effectively define a top surface of the supporting body. In other embodiments, however, the surfaces modeled by a surface model may be defined based upon multiple data values, e.g., multiple points.

Further, in some embodiments, a load profile may include various parameters associated with the weight of the load and/or any components of the load. A weight parameter, for example, may be the actual weight of a load or a component of a load, or may simply be a relative weight such as a categorization of the load as "heavy" or "light" or some other collection of ranges. In addition, a weight parameter may be based upon a single weight measurement or multiple weight measurements (e.g., to calculate an average or to select a maximum measurement), and a weight parameter may include the weight of the pallet or may have the weight of the pallet removed therefrom.

In addition, in some embodiments a load profile may also include one or more density parameters associated with a density of the load. Density, in this regard, may be considered to refer to a general relationship between the size of a load and its weight that is indicative of the relative stability of the load during wrapping. It will be appreciated, for example, that a relatively short load of relatively heavy products will likely be more stable than a relatively tall load of relatively light products, and as such, relative stability of a load may be based on a relationship between the size of the load and its weight.

A density parameter may be based upon the ratio of actual volume and the actual weight for a load in some embodiments, while in other embodiments, other values that are indicative of a relative density of a load may be used. For example, in some embodiments, a load may be assumed to be cuboid in shape regardless of its actual top surface topography, and a density parameter may be based upon a volume approximation calculated from the product of the overall height, length and width of the load. In other embodiments, no volume may be calculated, and an assumption may be made that all loads have similar lengths and widths, such that a height or elevation of a load and/or one or more components of the load may combined with a weight parameter in order to determine the density parameter. In still other embodiments, the size and/or the weight may be categorized into various ranges (e.g., "short" for less than $H_1$ inches, "medium" for between $H_1$ and $H_2$ inches and "tall" for more than $H_2$ inches and/or "light" for less than $X_1$ pounds, "normal" for between $X_1$ and $X_2$ pounds, and "heavy" for more than $X_2$ pounds), and a relative density parameter may be determined based upon these categorizations (e.g., "tall and light", "short and heavy", etc.).

A stability parameter may also be used in a load profile in some embodiments. In some embodiments, for example, a stability parameter associated with relative stability may be derived from a density parameter as discussed above. In other embodiments, stability may be sensed using a sensor. For example, in one embodiment a load may be subjected to a rocking motion through movement of a load support and force resolutions thereafter may be recorded (e.g., using one or more load cells coupled to the load support) to detect the amount of movement induced in the load. In still another embodiment, a rocking motion may be induced and one or more image sensors may detect an amount of movement induced in a top portion of the load.

Another load property that may be used in a load profile in some embodiments is a verticality property, representing the verticality of one or more sides of the load. The verticality may be used, for example, to detect a load that is leaning, a load that is twisted about the axis of rotation, a load that is irregular from layer to layer, etc. The verticality property may represent the degree to which a load is irregular, e.g., a load where at least some of the sides of the load are not substantially vertical and/or are not substantially planar in profile. An irregular load may result, for example, from differently-sized articles being placed in each layer, from adjacent layers of same-sized articles not being placed in perfect alignment, from the load leaning due to a weight imbalance, or from shifting of the load while on the conveyor or otherwise during movement of the load.

Figure 21:
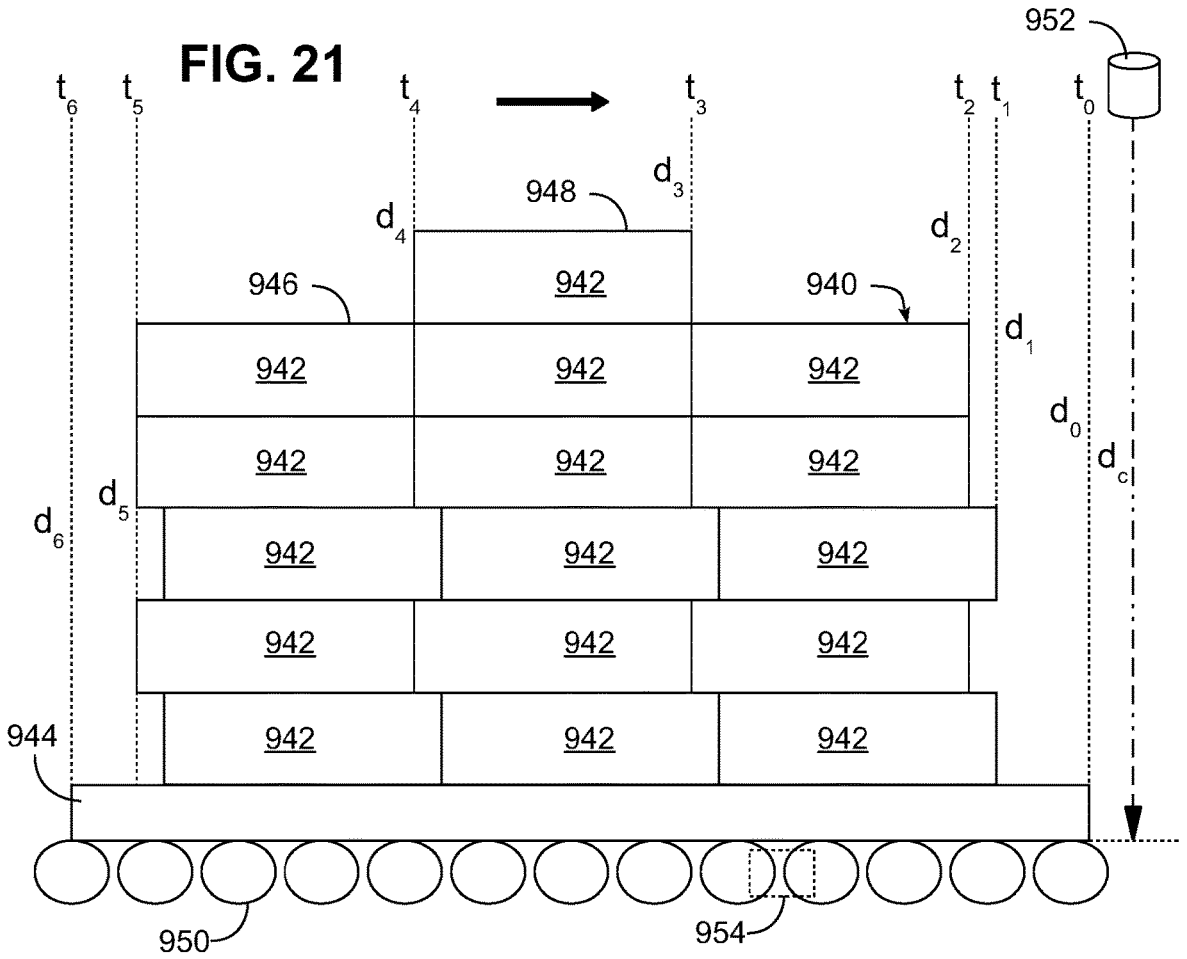
FIG. 21 is a functional side elevational view of an example load supported on a conveyor, and illustrating positioning of example weight and distance sensors relative thereto.

Verticality/irregularity may be detected, for example, based upon a surface model of the main body of a load, based on distance measurements taken from a sensor that changes in elevation with a packaging material dispenser, based upon distance measurements taken from a fixed sensor (e.g., as shown in FIG. 21 and discussed below), or in other manners that will be apparent to one of ordinary skill in the art having the benefit of the instant disclosure.

It will also be appreciated that in some embodiments, one or more load properties may be sensed by a sensor mounted to a wrapping machine or otherwise positioned to sense the load when the load is placed in a wrapping position, and further, in some embodiments, one or more load properties may be sensed by sensors positioned to sense the load prior to the load being placed in a wrapping position (e.g., while the load is on a conveyor, a pallet truck, or a lift truck, or while the load is positioned in a palletizer or other upstream handling equipment. Further still in some embodiments, one or more load properties may be based upon operator input, based on data stored in a database, or otherwise determined without the use of a sensor (e.g., if standard 40×48 pallets are used, properties such as pallet length, width, height and/or weight could be entered by an operator, stored in a database, or hard-coded into a control program).

The sensors used to sense various load properties for incorporation in a load profile may vary in different embodiments. FIG. 5, for example, illustrates a sensing device 628, e.g., a photoelectric sensor, laser, ultrasonic sensor, etc. operatively coupled to elevator 612 and capable of sensing an elevation or height of load 606, as well as a load cell 630 or other weight sensor capable of sensing a weight of load 606 placed on turntable 604.

In some instances, one sensor may be used to directly determine the height of an inboard portion of a load as well as to determine the height of a load not having an inboard portion. In other instances, however, it may be desirable to use a different sensor to sense the height of an inboard portion of a load, e.g., any of sensors 632, 634 or 636 of FIG. 5. Sensor 632 is operatively coupled to elevator 612 at a different elevation from sensor 628 (and may, in some embodiments, be adjustable to different elevations relative to the elevator), while sensors 634 and 636 are mounted to fixed locations. Sensor 634, for example, is positioned to the side of a load, and may be mounted directly to wrapping apparatus 600 or mounted to another structure proximate the apparatus. Sensor 636 may be mounted above load 606 (e.g., mounted to the wrapping apparatus or other structure proximate thereto) and project downwardly. It will be appreciated that while sensors 628-636 are all illustrated as being used together in FIG. 5, in many embodiments only one or more of such sensors may be used. As an example, a sensor 636 may be configured as a digital camera, range imaging sensor, or three-dimensional scanning sensor capable of producing data from which a three-dimensional model of the various surfaces of the load may be constructed, and as such, a single sensor 636 may only be needed in some embodiments. One example sensor that may be used in some embodiments is the O3D three-dimensional camera available from ifm efector, inc.

Other types of sensors may be used to measure various properties of the load, e.g., other types of sensors capable of sensing dimensions and/or surfaces such as proximity sensors, laser distance sensors, ultrasonic distance sensors, digital cameras, range imaging sensors, three-dimensional scanning sensors, light curtains, sensor arrays, etc., as well as other types of sensors capable of sensing weight such as load cells, conveyor-mounted scales or load cells, etc. Other sensors not explicitly mentioned herein but suitable for use in some embodiments will be appreciated by those of ordinary skill in the art having the benefit of the instant disclosure. Further, it will be appreciated that sensing or measuring of a load may also be performed prior to the load being placed or conveyed to a wrapping location, e.g., while the load is being conveyed to a wrapping apparatus.

Figure 6A:
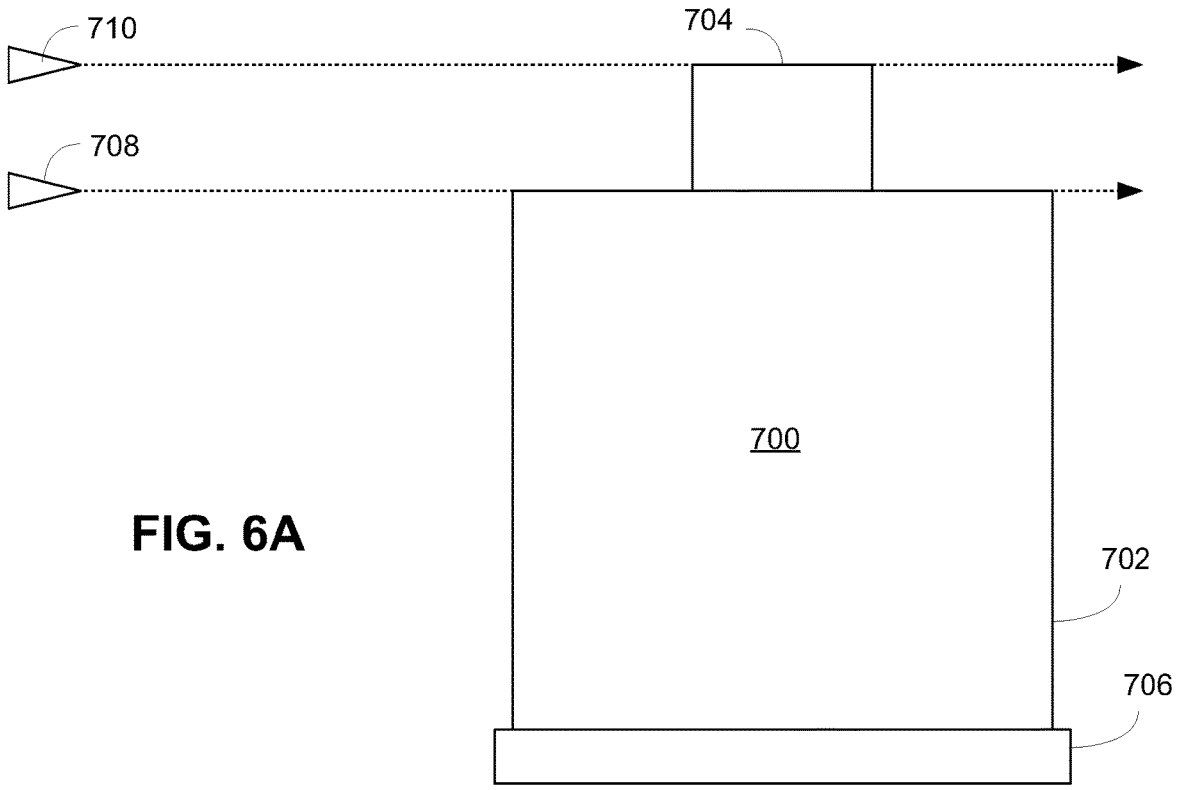
FIG. 6A is a functional side elevational view of an example load including an inboard portion consistent with the invention, and further illustrating the use of multiple height sensors consistent with the invention.
Figure 6B:
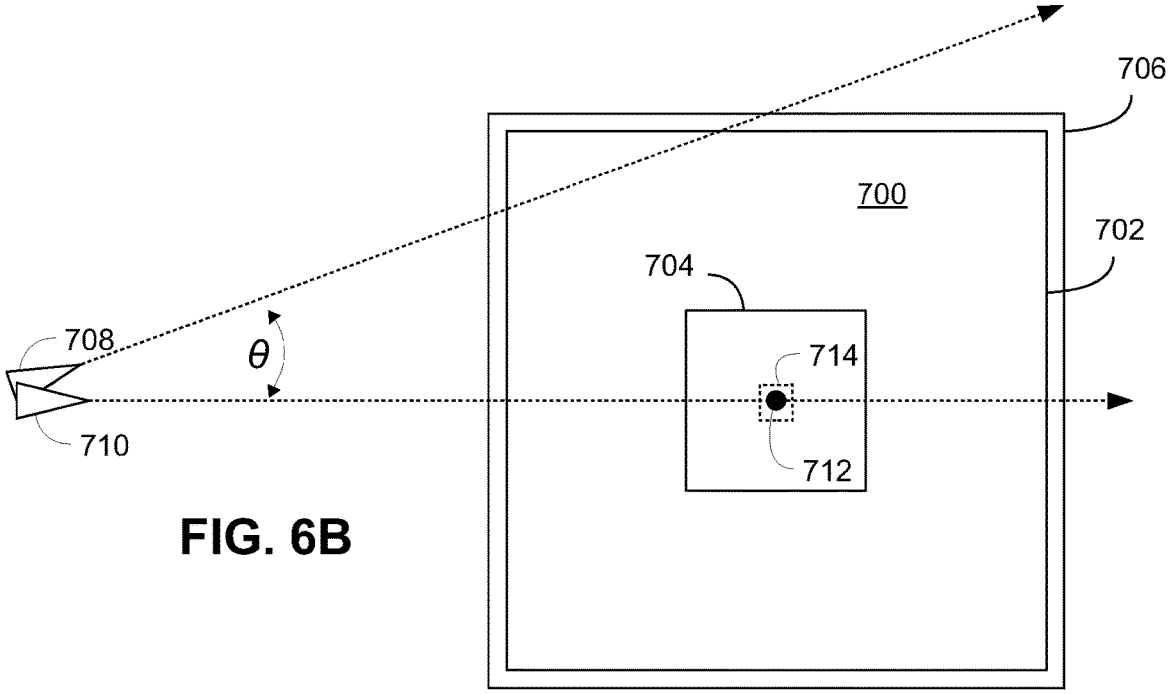
FIG. 6B is a functional top plan view of the example load of FIG. 6A.

In some embodiments, an off-axis sensor may be used to detect the height of a supporting body and thereby enable the height of an inboard portion of a load to be separately determined by an on-axis sensor. The term "off-axis", in this regard, refers to a sensing direction of a sensor that does not intersect the axis of rotation between a load and a packaging material dispenser. With reference to FIGS. 6A-6B, for example, a load 700 may include a main body 702 supporting an inboard portion 704 and supported on a pallet 706. As shown in FIG. 6A, a first, off-axis sensor 708 may be disposed at a first elevation relative to a roll carriage or elevator and a second, on-axis sensor 710 is disposed at a second, higher elevation relative to the roll carriage or elevator, and offset a predetermined distance from the first sensor 708. As shown in FIG. 6B, off-axis sensor 708 is directed at an angle θ offset from an axis of rotation 712 of load 700, while on-axis sensor 710 is directed toward axis of rotation 712.

By directing off-axis sensor 708 offset from axis of rotation 712, off-axis sensor 708 may detect the presence of main body 702 without detecting inboard portion 704. In some embodiments, for example, off-axis sensor 708 may be oriented to detect main body 702 of load 700 about 10" inside of a corner of main body 702 when main body 702 is oriented in the position illustrated in FIG. 6B, although other orientations relative to load 700 and/or axis of rotation 712 may be used in other embodiments. In some embodiments, each sensor 708, 710 may be implemented using a laser or photoelectric proximity sensor based upon time-of-flight sensing, e.g., the FT55-RLHP2 sensor available from Sensopart Industriesensorik GmbH.

In addition, in some embodiments, it may be desirable to sense the heights of the supporting body and/or inboard portion of the load while the load is stationary (i.e., when there is no relative rotation between the load and a packaging material dispenser). In one embodiment, for example, a wrap cycle may begin with a roll carriage or elevator rising from a bottom position while no relative rotation is performed between the load and the packaging material dispenser. During this process, off-axis sensor 708 scans for the top of main body 702 while on-axis sensor 710 scans for the top of inboard portion 704.

In still other embodiments, determination of the presence and/or dimensions of an inboard portion of a load may be made using one or more sensors capable of automatically determining a three-dimensional profile of at least the top of a load. Various types of cameras, range imaging sensors, three-dimensional scanning sensors, etc. may be used, for example, to determine a complete profile of the top of a load, including the topography of the top of the load as well as the overall length and width of a main body of the load. In some embodiments, other types of information related to a three-dimensional profile may also be sensed and/or derived from a three-dimensional profile, e.g., the presence/absence of an inboard portion, the height of the inboard portion and/or a supporting body of the load, the dimensions, orientation and/or position of an inboard portion and/or any individual cartons or products making up an inboard portion, etc.

Figure 7:
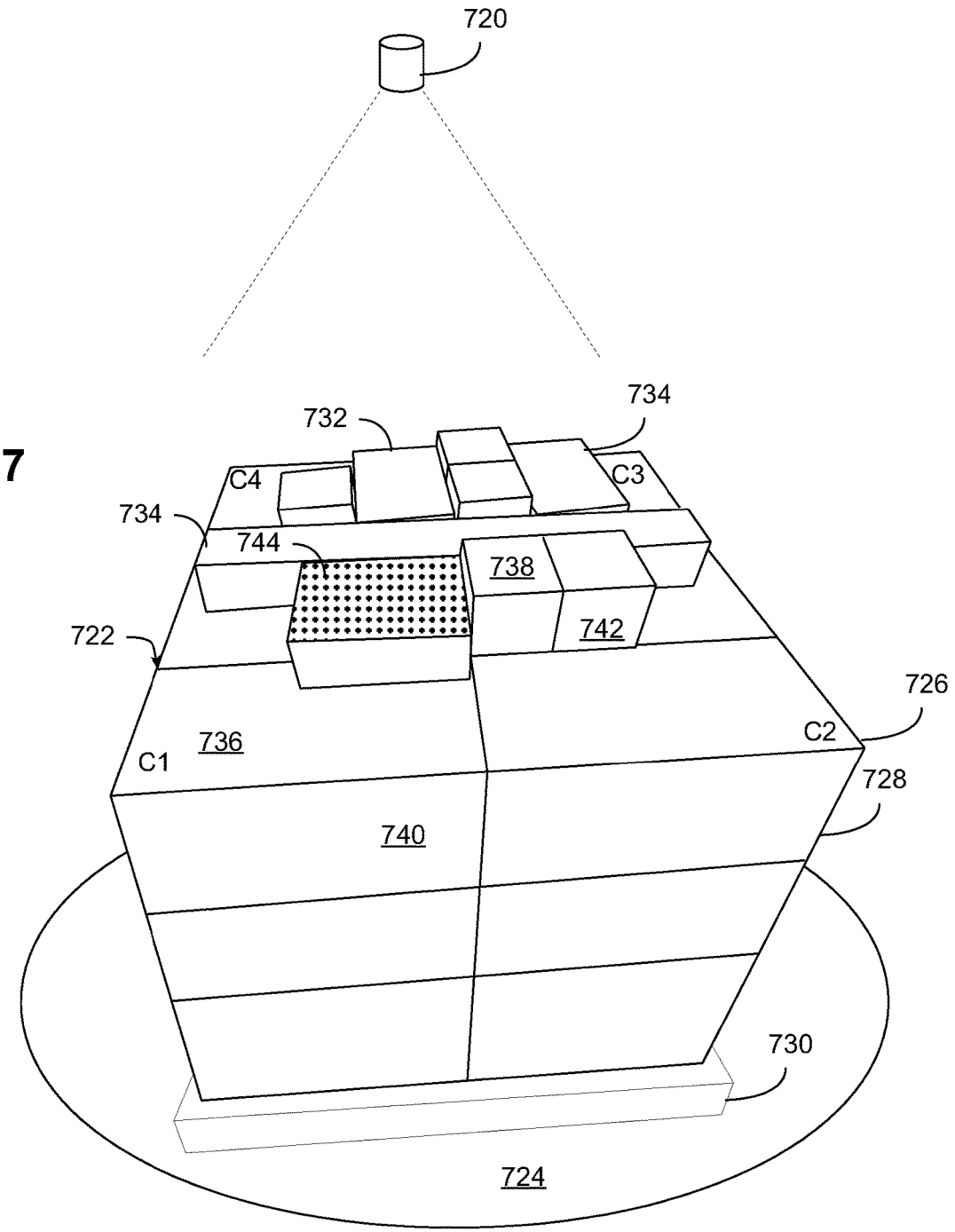
FIG. 7 is a perspective view of an example load including a ragged topography.

FIG. 7, for example, illustrates an overhead sensor 720 configured, for example, as a three-dimensional scanning sensor. Sensor 720 may be positioned overhead of a load 722 and may be capable of generating data suitable for use in constructing a three-dimensional surface model of at least the top surface(s) of the load. For example, load 722 may be disposed on a load support 724 and may include a main body 726 including a regular arrangement of stacked cartons 728 supported on a pallet 730. Load 722, however, may have an incomplete top layer 732 formed of one or more cartons 734 that may be considered to be an inboard portion of the load. Load 722 as illustrated is considered to present a ragged top surface topography due to the differing elevations at different locations on the top of the load (e.g., based upon differing elevations of top surface 764 of main body and top surfaces 738 of cartons 734 in top layer 732.

Figure 8:
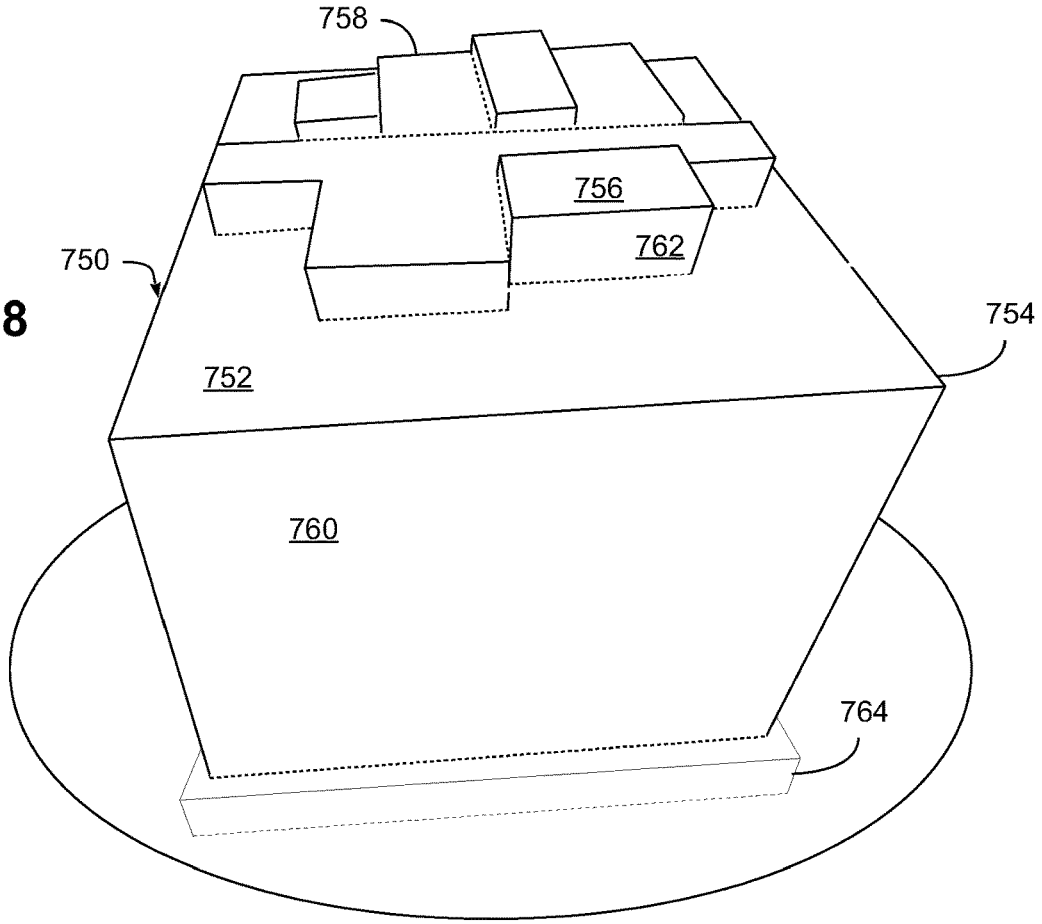
FIG. 8 is a perspective view of an example surface model generated for the example load of FIG. 7.
Figure 9:
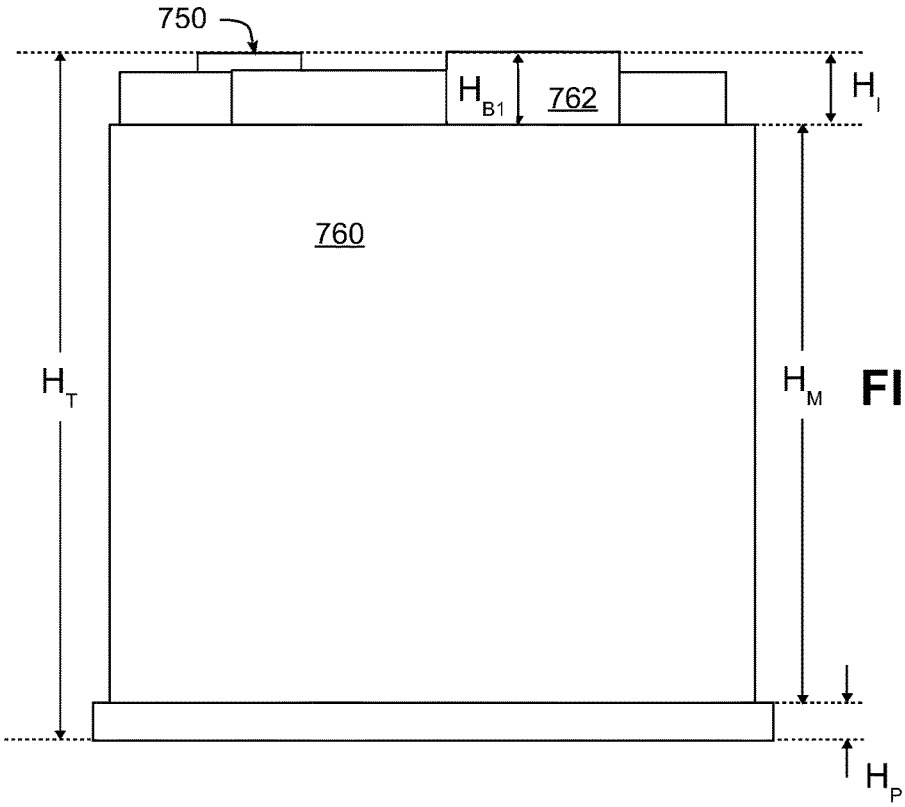
FIG. 9 is a functional side elevational view of the example surface model of FIG. 8.
Figure 10:
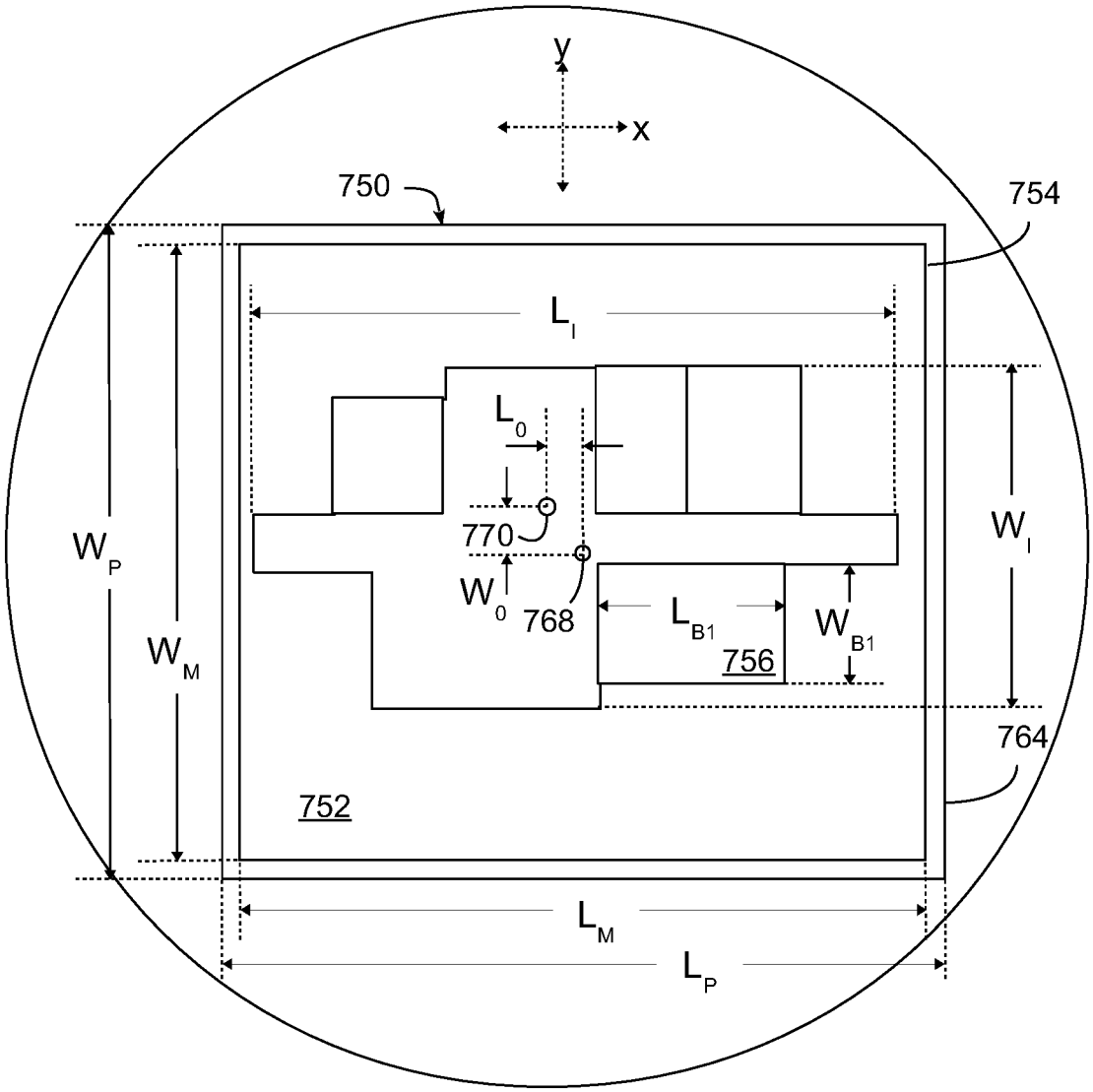
FIG. 10 is a functional top plan view of the example surface model of FIG. 8.

FIGS. 8-10 illustrate an example surface model 750 that may be generated for load 722 based upon data generated by sensor 720 of FIG. 7. Surface model 750 includes a top surface 752 of a volume 754 corresponding to top surface 736 of main body 726, as well as a top surface 756 of a volume 758 corresponding to a top surface 738 of top layer 732. In some embodiments, only top (upwardly-facing surfaces) may be modeled, while in other embodiments, other surfaces e.g., side surfaces 760, 762, as well as various surfaces 764 corresponding to a pallet, may also be incorporated into a model.

It will be appreciated from FIGS. 9 and 10 that a wide variety of dimensional values may be determined for load 722 using surface model 750. For example, as illustrated in FIG. 9, various heights or elevations may be determined, e.g., a total height for the load ($H_T$), a height of the main body ($H_M$), a height of the inboard portion ($H_I$), a height of the pallet ($H_P$), or even the height of individual cartons/components in the inboard portion ($H_{B1}$). Likewise, as illustrated in FIG. 10, various dimensions in an x-y plane (referred to herein as cross-sectional dimensions), such as various lengths and/or widths, may also be determined, e.g., a length/width of the main body ($L_M$, $W_M$, which may also correspond to a total length/width), a length/width of the inboard portion ($L_I$, $W_I$), a length/width of the pallet ($L_P$, $W_P$), or even the length/width of individual cartons/components in the inboard portion ($L_{B1}$, $W_{B1}$). Further, additional information, such as the offset of the geometric center of the load 768 and an axis of rotation 770 (represented using length $L_O$ and width $W_O$), any rotational offset of the load, and other dimensions may also be determined. It will also be appreciated that additional dimensional information may be derived from other data, e.g., to determine surface areas, volumes, etc. It will further be appreciated that while FIGS. 8-10 illustrate a load containing regularly arranged cuboid-shaped articles, loads are not restricted to such shapes, and practically any shape of a load, including shapes incorporating curved edges and/or surfaces, may be represented using a surface model consistent with the invention.

Returning to FIG. 7, depending upon the configuration and orientation of sensor 720, sensor 720 may determine the locations of multiple points along multiple surfaces of load 722, e.g., as illustrated for surface 744. For example, when positioned overhead of load 722 as illustrated in FIG. 8, sensor 720 may generate (x, y, z) coordinates for multiple points on at least top surfaces 736, 738 of load 722, e.g., a regular array of points within a sensing window of sensor 720, and from such information, the size, location and/or orientation of a plurality of surfaces may be determined and represented within a surface model.

Automatic Load Profiling

Figure 11:
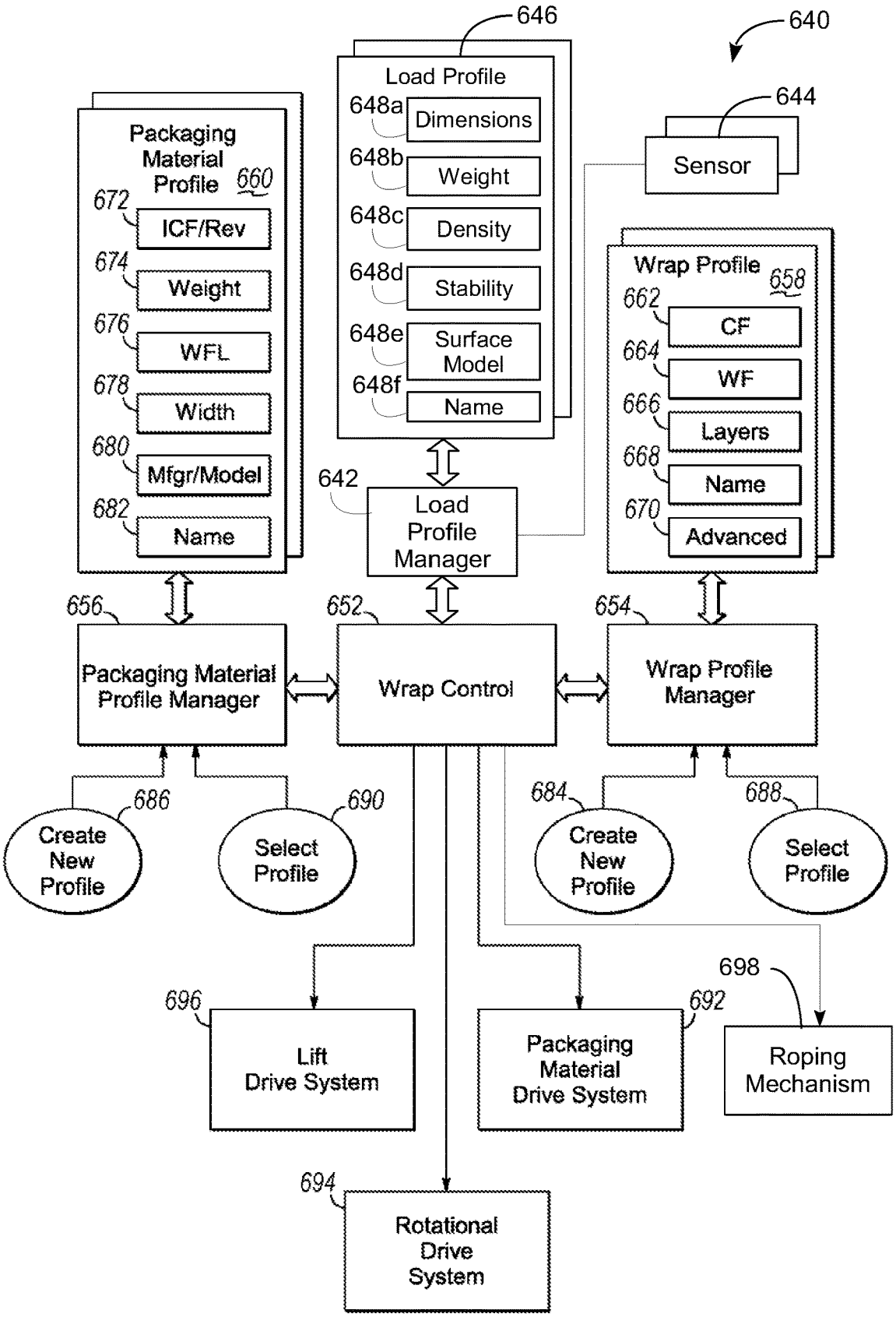
FIG. 11 is a block diagram illustrating an example wrapping apparatus control system consistent with the invention.

Now turning to FIG. 11, an example control system 640 for a wrapping apparatus may implement automatic load profiling and wrapping based at least in part on automatically-generated load profiles. A wrap control block 652 is illustrated as coupled to a load profile manager block 642, which is in turn coupled to one or more sensors 644 suitable for sensing data usable in creating one or more a load profiles 646. Load profile manager block 642 may collect data from sensors 644 and generate various load properties for inclusion in a load profile 646 for a load, including, for example, various dimension parameters 648*a*, weight parameters 648*b*, density parameters 648*c* and/or stability parameters 648*d*. In addition, in some embodiments, a load profile manager block 642 may generate a surface model 648*e* for incorporation into load profile 646, and further, in some embodiments, a name 648*f* or other identifier may be included in a load profile to enable to profile to be accessed at a later point in time.

In some embodiments, load profile manager block 642 may be controlled by wrap control block 652 to analyze a load positioned in a wrapping position prior to wrapping such that a load profile may be generated for access by wrap control block 652 to generate or modify a suitable wrap profile to be used when wrapping the load. In some embodiments, load profiles may be stored in a database or other data store and accessed in response to operator input or input from an external device. In still other embodiments, load profile manager block 642 may analyze a load prior to the load being positioned in a wrapping position, and in some instances, load profile manager block 642 may be implemented within a device that is external to a wrapping apparatus, and in some embodiments some of all of the data in a load profile may be input by an operator, retrieved from a database, or otherwise received from non-sensor data.

Wrap control block 652 is additionally coupled to a wrap profile manager block 654 and a packaging material profile manager block 656, which respectively manage a plurality of wrap profiles 658 and packaging material profiles 660.

Each wrap profile 658 stores a plurality of parameters, including, for example, a containment force parameter 662, a wrap force (or payout percentage) parameter 664, and a layer parameter 666. In addition, each wrap profile 658 may include a name parameter providing a name or other identifier for the profile. In addition, a wrap profile may include additional parameters, collectively illustrated as advanced parameters 670, that may be used to specify additional instructions for wrapping a load. Additional parameters may include, for example, an amount of overlap, number of top/bottom wraps, wrap force variations for different areas of the load, rotation speeds for different areas of the load and/or times during the wrap cycle, band positions and wrap counts, a rotational data shift to apply during wrapping, whether a load is inboard of a pallet, etc.

In addition, in some embodiments the advanced parameters 670 may also include indicators as to whether a top layer containment operation should be performed, and if so, what type of operation and/or any parameters controlling how the operation should be performed (e.g., number of revolutions, how far inward the packaging material should pass from each corner, etc.). Some or all of these parameters may be input by an operator in some embodiments, while in some embodiments one or more of these parameters may be automatically selected or generated based upon automatic load profiling.

A packaging material profile 660 may include a number of packaging material-related attributes and/or parameters, including, for example, an incremental containment force/revolution attribute 672 (which may be represented, for example, by a slope attribute and a force attribute at a specified wrap force), a weight attribute 674, a wrap force limit attribute 676, and a width attribute 678. In addition, a packaging material profile may include additional information such as manufacturer and/or model attributes 680, as well as a name attribute 682 that may be used to identify the profile. Other attributes, such as cost or price attributes, roll length attributes, prestretch attributes, or other attributes characterizing the packaging material, may also be included.

Each profile manager 654, 656 supports the selection and management of profiles in response to input data, e.g., as entered by a user or operator of the wrapping apparatus. For example, each profile manager may receive user input 684, 686 to create a new profile, as well as user input 688, 690 to select a previously-created profile. Additional user input, e.g., to modify or delete a profile, duplicate a profile, etc. may also be supported. Furthermore, it will be appreciated that user input may be received in a number of manners consistent with the invention, e.g., via a touchscreen, via hard buttons, via a keyboard, via a graphical user interface, via a text user interface, via a computer or controller coupled to the wrapping apparatus over a wired or wireless network, etc. Similar functionality may also be supported for load profile manager 642 in some embodiments.

In addition, load, wrap and/or packaging material profiles may be stored in a database or other suitable storage, and may be created using control system 640, imported from an external system, exported to an external system, retrieved from a storage device, etc. In some instances, for example, packaging material profiles may be provided by packaging material manufacturers or distributors, or by a repository of packaging material profiles, which may be local or remote to the wrapping apparatus. Alternatively, packaging material profiles may be generated via testing.

A load wrapping operation using control system 640 may be initiated, for example, upon selection of a wrap profile 658 and a packaging material profile 660, as well upon selection or generation of a load profile 646, e.g., based upon sensing of the load using one or more sensors 644. Doing so results in initiation of a wrapping operation through control of a packaging material drive system 692, rotational drive system 694, and lift drive system 696. Further, in some embodiments where top layer containment operations are performed, a roping mechanism 698 may also be controlled. Additional controllable components, e.g., clamps, heat sealers, etc., may also be controlled at appropriate points in a wrap cycle.

Wrap profile manager 654 may also include functionality for automatically calculating one or more parameters in a wrap profile based upon a load profile and/or one or more other wrap profile parameters. For example, wrap profile manager 654 may be configured to select a top layer containment operation for a wrap profile and/or may select a load containment force requirement for the wrap profile based in part on a density parameter in the load profile.

Furthermore, wrap profile manager 654 may include functionality for automatically calculating one or more parameters in a wrap profile based upon a selected packaging material profile and/or one or more other wrap profile parameters. For example, wrap profile manager 654 may be configured to calculate a layer parameter and/or a wrap force parameter for a wrap profile based upon the load containment force requirement for the wrap profile and the packaging material attributes in a selected packaging material profile. In addition, in response to modification of a wrap profile parameter and/or selection of a different packaging material profile, wrap profile manager 654 may automatically update one or more wrap profile parameters.

FIGS. 12-15 next illustrate an example of automatic load profiling using the control system of FIG. 11. In this example, two types of automatic load profiling are supported. The first, referred to herein as density-based load profiling, determines a density parameter for a load based at least in part on sensor data collected for the load, and uses the density parameter to control one or more control parameters for at least a main portion of a wrapping cycle, i.e., that portion of a wrapping cycle during which packaging material is wrapped in a spiral manner around the sides of a load. The second, referred to herein as top layer containment operation activation-based load profiling, selectively enables a top layer containment operation during a wrapping cycle to address an issue associated with a nonstandard top layer of the load, and in some instances additionally controls one or more control parameters associated with an activated top layer containment operation. For the purposes of FIGS. 12-15, both types of load profiling are supported and are based at least in part upon a surface model generated from one or more sensors directed at the load. It will be appreciated by one of skill in the art having the benefit of the instant disclosure, however, that in some embodiments only one type of load profiling may be supported, and further, that automatic load profiling may be implemented using other sensed and/or collected data. It will also be appreciated that automatic load profiling may be used in other embodiments to automatically control other control parameters based upon other collected properties beyond those disclosed herein. Therefore, the invention is not limited to the specific implementations discussed herein.

Figure 12:
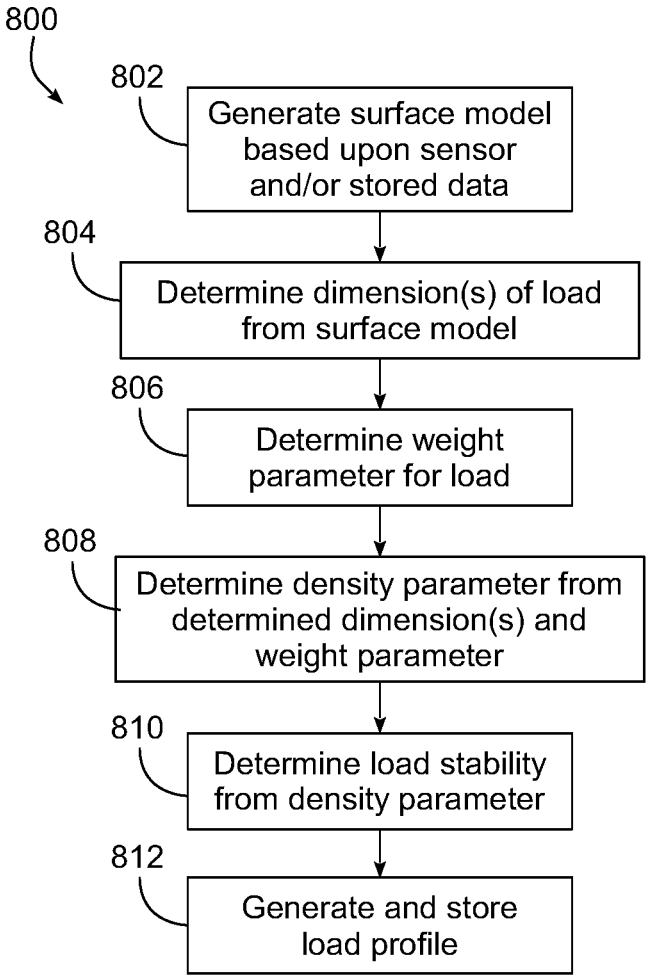
FIG. 12 is a flowchart illustrating an example sequence of operations for generating a load profile using the control system of FIG. 11.
Figure 13:
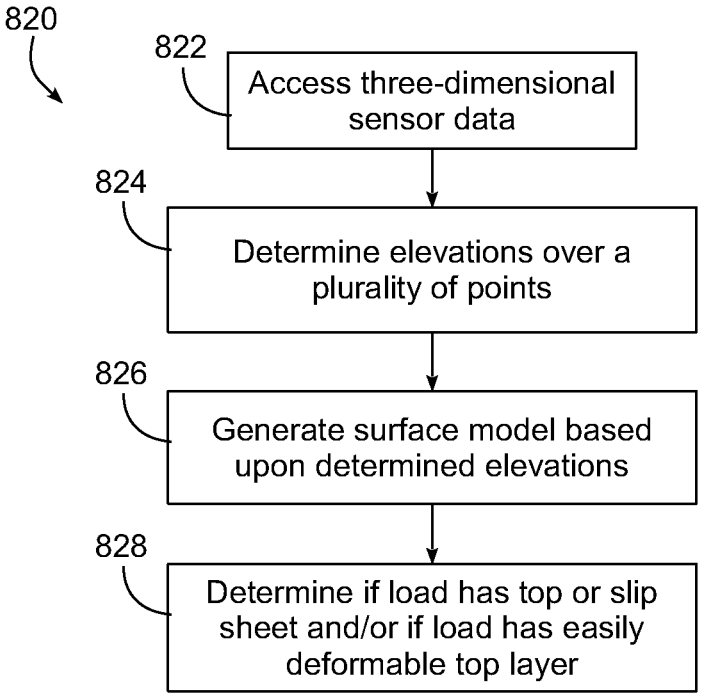
FIG. 13 is a flowchart illustrating an example sequence of operations for generating a surface model for the load profile generated in FIG. 12.

Now turning to FIG. 12, this figure illustrates at 800 an example sequence of operations for generating a load profile using the control system of FIG. 11. A surface model may be generated based upon sensor and/or stored data (block 802), e.g., using any of the various sensors and/or techniques discussed above.

Next, in block 804, one or more dimensions of the load may be determined from the surface model, and in block 806, a weight parameter may be determined for the load, e.g., based upon a sensed weight from a scale, based upon an input from an upstream weight sensor, based upon a relative weight (e.g., light, normal, heavy) etc. Next, in block 808, a density parameter is determined for the load based upon the determined dimension(s) and weight parameter, and in block 810, a load stability is determined from the density parameter, e.g., to characterize the load as stable or unstable. Then, based upon the aforementioned determined properties, the load profile is generated and stored in the control system in block 812.

Returning to block 802, a surface model may be generated in a number of manners consistent with the invention. For example, as illustrated at 820 in FIG. 13, a surface model may be generated in some embodiments by accessing three-dimensional sensor data such as image or range data collected from an overhead digital camera, range imaging sensor, three-dimensional scanning sensor, etc. (block 822). Next, in block 824 a plurality of elevations may be determined over a plurality of points, e.g., over a regular array of points within a sensing window of a sensor (e.g., as discussed above in connection with FIG. 7). Next, in block 826 the surface model may be generated from the determined elevations, e.g., by identifying and modeling planar surfaces detected from the elevations and/or generating dimensions of one or more of a pallet, a main body, an inboard portion, individual products or cartons, etc. In other embodiments, the surface model may simply be represented by the set of calculated elevations or distances derived therefrom, or by a set of dimensions determined from the calculated elevations.

Next, in block 828, an attempt may also be made to determine if a load has a top or slip sheet and/or if a load has an easily deformable top layer. As an example, if the sensor data is collected from an image-based sensor, image data may be analyzed to attempt to identify shapes, colors, reflectivity, markings, or other visual structures to determine whether a top sheet or a slip sheet has been placed on the top of the load. A slip sheet, for example, may be formed of cardboard and may have both a characteristic brown color and a characteristic rectangular size and shape that may be readily detected through image analysis. In addition, in some embodiments image analysis may be performed to attempt to determine if a top layer of a load is easily deformable or crushable, e.g., by attempting to detect whether products in the top layer are in cartons or not, or by attempting to detect characteristic shapes and/or colors of easily deformable products such as paper towels, beverage bottles, etc. In other embodiments, however, block 828 may be omitted, and no attempt may be made to sense the presence of a top/slip sheet and/or easily deformable top layer.

Figure 14:
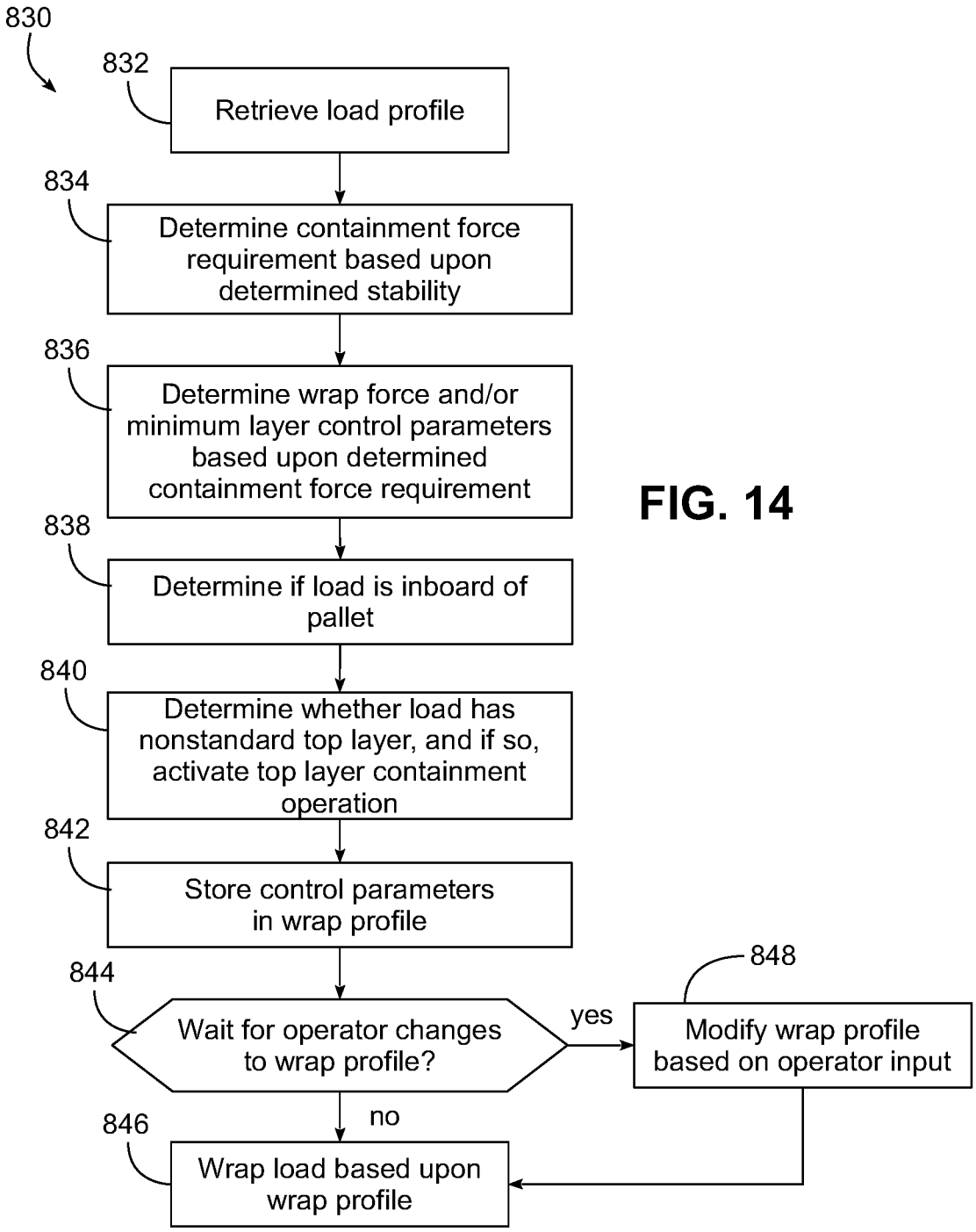
FIG. 14 is a flowchart illustrating an example sequence of operations for wrapping a load using the load profile generated in FIG. 12.

Now turning to FIG. 14, this figure illustrates at 830 an example sequence of operations for wrapping a load using the load profile generated in FIG. 12. First, in block 832, the load profile is retrieved, and then in block 834, a load containment force requirement may be determined from the determined stability stored in the load profile. In some embodiments, for example, the determined stability may be selected from among a plurality of different load stability types that are each mapped to different load containment force requirements, e.g., as discussed in U.S. Provisional Application No. 62/060,784 filed on Oct. 7, 2014 by Patrick R. Lancaster III et al., which is incorporated by reference herein. As one example, four stability types may be used and selected based upon density and mapped to different containment force ranges, e.g., a light, stable load may be mapped to 2-5 lbs of containment force, a light, unstable load may be mapped to 5-7 lbs of containment force, a heavy, stable load may be mapped to 7-12 lbs of containment force, and a heavy, unstable load may be mapped to 12-20 lbs of containment force.

Then, in block 836, wrap force and/or minimum layer control parameters may be determined based upon the determined containment force requirement. As discussed in the aforementioned cross-referenced application, for example, the containment force requirement and the properties of the packaging material to be used in the wrapping operation may be used to determine an incremental containment force (ICF) parameter, from which a wrap force parameter and a minimum number of layers parameter may be calculated. Further details regarding the determination of control parameters from containment force, and the control of a wrapping operation based upon containment force, are discussed, for example, in U.S. Patent Application Publication No. 2014/0116006, entitled "ROTATION ANGLE-BASED WRAPPING," and filed Oct. 25, 2013; U.S. Patent Application Publication No. 2014/0116007, entitled "EFFECTIVE CIRCUMFERENCE-BASED WRAPPING," and filed Oct. 25, 2013; U.S. Patent Application Publication No. 2014/0116008, entitled "CORNER GEOMETRY-BASED WRAPPING," and filed Oct. 25, 2013; U.S. Patent Application Publication No. 2014/0223863, entitled "PACKAGING MATERIAL PROFILING FOR CONTAINMENT FORCE-BASED WRAPPING," and filed Feb. 13, 2014; U.S. Patent Application Publication No. 2014/0223864, entitled "CONTAINMENT FORCE-BASED WRAPPING," and filed Feb. 13, 2014; and U.S. Patent Application Publication No. 2015/0197360, entitled "DYNAMIC ADJUSTMENT OF WRAP FORCE PARAMETER RESPONSIVE TO MONITORED WRAP FORCE AND/OR FOR FILM BREAK REDUCTION," and filed Jan. 14, 2015, all of which are incorporated herein by reference in their entirety.

It will be appreciated that in other embodiments, no intermediate stability type may be stored in a load profile and/or used to determine a containment force requirement for a load, such that the density parameter may be used to directly determine a containment force requirement for a load. Further, in other embodiments, a density parameter may be used to control other parameters used in other types of wrapping machines given that the density may be considered to represent a relative stability of a load in many situations. For example, a density parameter may be used to control wrap force, tension, payout percentage, carriage speed, rotation speed, conveyor speed and/or other types of control parameters that may be used in other types of wrapping machines.

Next, in block 838, a determination may also be made as to whether a load is inboard of a pallet, and if so, a distance that the load is inboard. Such a determination may be based, for example, on a comparison of the cross-sectional dimensions of a pallet and a main body of a load, as determined from the surface model. The presence of an inboard load on a pallet may be used to decrease a wrap force used while wrapping around the pallet and/or to increase a number of layers applied proximate a pallet to reduce the risk of packaging material breaks occurring while wrapping packaging material around the pallet.

Next, in block 840, a determination is made as to whether the load has a nonstandard top layer, and if so, a top layer containment operation is activated, and optionally, one or more control parameters for the top layer containment operation are generated. Various types of top layer containment operations are disclosed, for example, in U.S. Provisional Application No. 62/145,789 filed on Apr. 10, 2015, U.S. Provisional Patent Application Ser. No. 62/232,906 filed on Sep. 25, 2015, and PCT Application No. PCT/US2016/026723 filed on Apr. 8, 2016, each of which is incorporated by reference herein.

Next, in block 842, the determined control parameters are stored in a wrap profile, and block 844 determines whether to wait for operator changes to be made to the wrap profile. In some embodiments, for example, automatic load profiling may not incorporate any operator input and/or may not be initiated and/or completed until after a wrapping cycle has been initiated (e.g., activation of a top layer containment operation may not be performed until a sensor mounted on a packaging material dispenser carriage has moved to a position where an inboard load can be detected), so after control parameters have been automatically determined, block 844 may pass control directly to block 846 to wrap the load based upon the wrap profile. In other embodiments, however, the control parameters stored in the wrap profile may be accessible by an operator and may be modified if desired, and the operator may be required to manually initiate a wrapping operation (e.g., by pressing a start button). In such instances, therefore, block 844 may pass control to block 848 to modify the wrap profile based upon operator input, and then to block 846 to wrap the load. It will be appreciated that due to the fact that automatic load profiling may be performed based upon sensor data collected upstream of a wrapping machine, at a wrapping position and/or during a wrapping cycle, and that at least some of the load properties for a load may be based on operator input and/or retrieved from a database or external device, the types of operator interaction (if any) that may be performed between generating control parameters based upon automatic load profiling and actually wrapping a load using those control parameters may vary substantially in different embodiments.

Block 842 may, in some embodiments, configure a wrap profile e.g., by creating a new wrap profile or modifying an existing wrap profile. In other embodiments, block 842 may select from among preexisting wrap profiles based upon the load profile.

Figure 15:
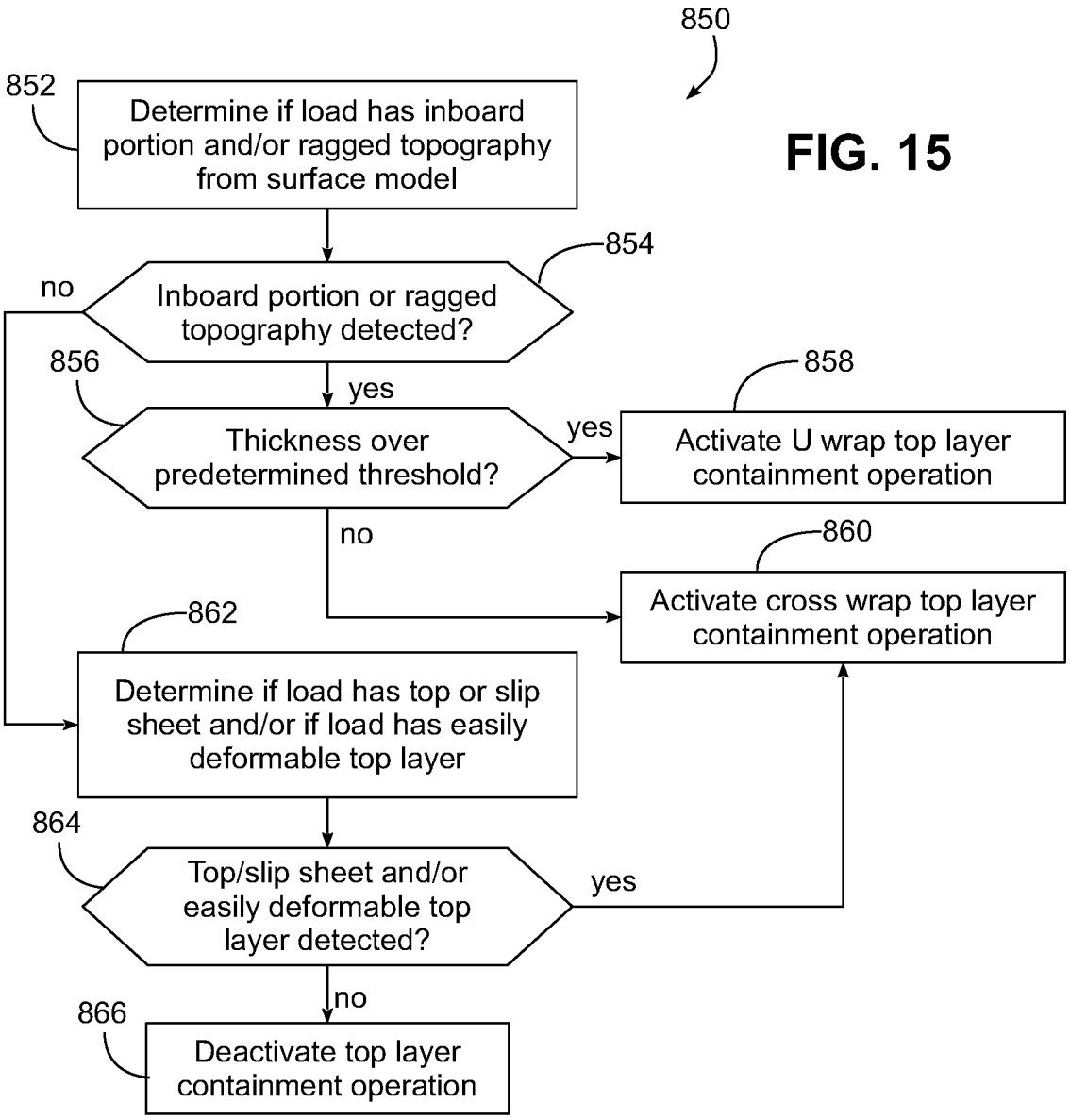
FIG. 15 is a flowchart illustrating an example sequence of operations for activating a top layer containment operation using the load profile generated in FIG. 12.

FIG. 15 next illustrates at 850 an example sequence of operations for activating a top layer containment operation using the generated load profile, e.g., as may be performed in block 840 of FIG. 14. Block 852 may first determine from the surface model whether a load has an inboard portion and/or ragged topography, i.e., whether the load includes an incomplete top layer that is substantially inboard of a main body of a load, whether the load includes a product that is substantially inboard of a pallet, or whether the load has a top layer with varying elevations. An inboard portion may be detected, for example, if the elevation of the load proximate the geometric center of the load is substantially higher than that of the elevation of the load proximate the perimeter of the pallet, while a ragged topography may be detected, for example, if the elevation substantially varies across the top of the load. If an inboard portion is detected, block 854 passes control to block 856 to determine whether the thickness of the inboard portion is above a predetermined threshold (e.g., about 5 or 6 inches in some embodiments). The thickness may be determined based upon a difference between the elevations of the inboard portion and a main body or pallet of the load. The thickness may also be based upon maximum, minimum, average, or median elevations of each respective portion of the load in some embodiments.

If above the threshold, block 856 passes control to block 858 to activate a "U wrap" top layer containment operation, and if not, block 856 passes control to block 860 to activate a "cross wrap" top layer containment operation, the details of which will be discussed in greater detail below.

Returning to block 854, if no inboard portion or ragged topography is detected, block 854 passes control to block 862 to determine if the load has a top or slip sheet and/or if the load has an easily deformable top layer. Block 862 in some embodiments may determine these nonstandard top layers automatically based upon sensor data, as discussed above in connection with block 828 of FIG. 13. In other embodiments, however, no automatic detection may be supported, and the presence of such nonstandard top layers may be indicated based upon operator input or input from an upstream or other external device (e.g., based upon a signal from a machine that places a slip sheet on the load, based upon a database record associated with the load and indicating a deformable product type, etc.).

If either of such nonstandard top layer is determined to be present on the load, block 864 passes control to block 860 to activate the cross wrap top layer containment operation. Otherwise, block 864 passes control to block 866 to deactivate all top layer containment operations, such that the load will be wrapped using a traditional, spiral wrapping operation with no additional packaging material wrapped over a top surface of the load.

Figure 16:
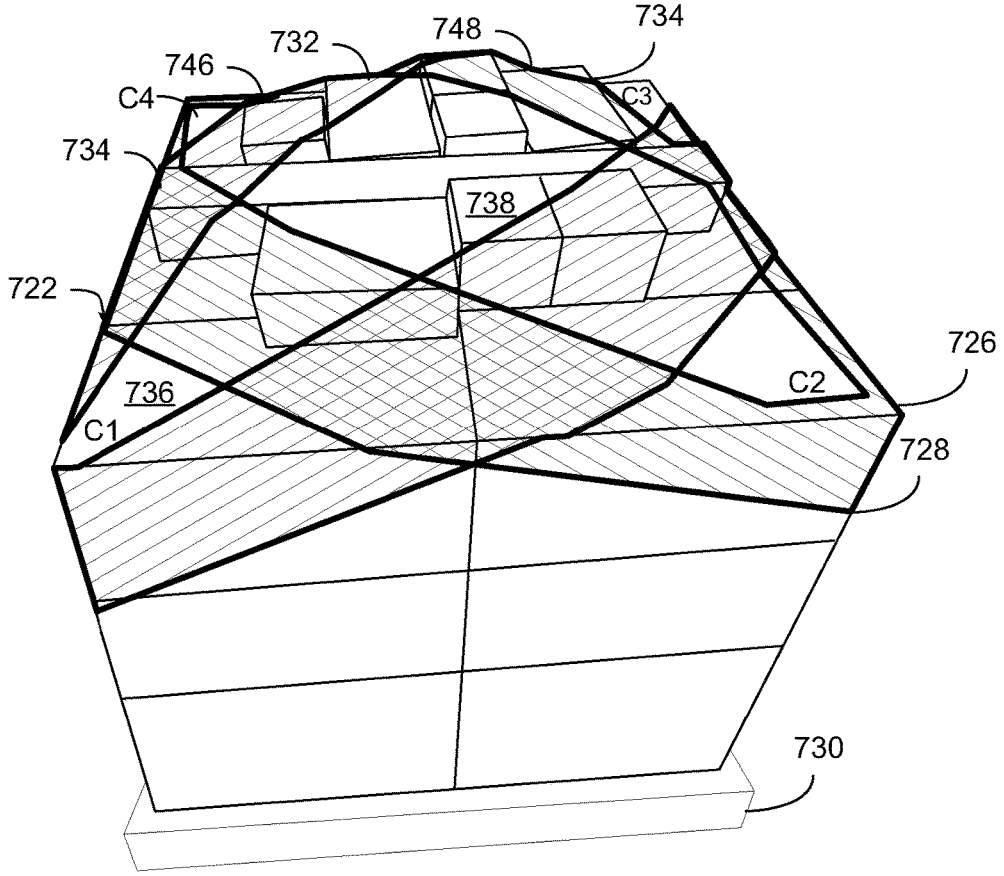
FIG. 16 illustrates an example cross wrap top layer containment operation performed on the load of FIG. 7.
Figure 17:
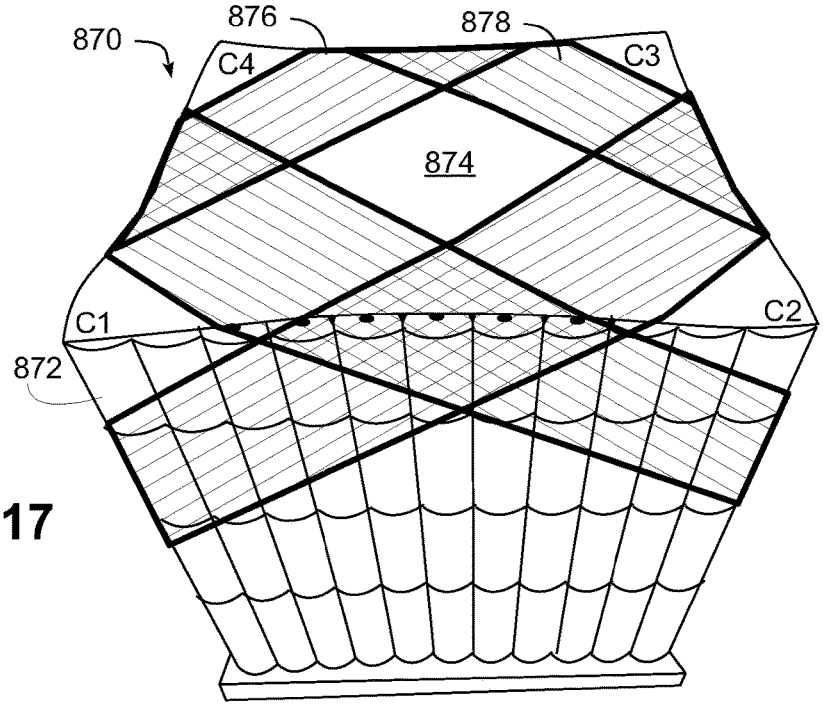
FIG. 17 is a perspective view of an example load including an easily deformable top layer and slip sheet, and an example cross wrap top layer containment operation performed thereon.
Figure 18:
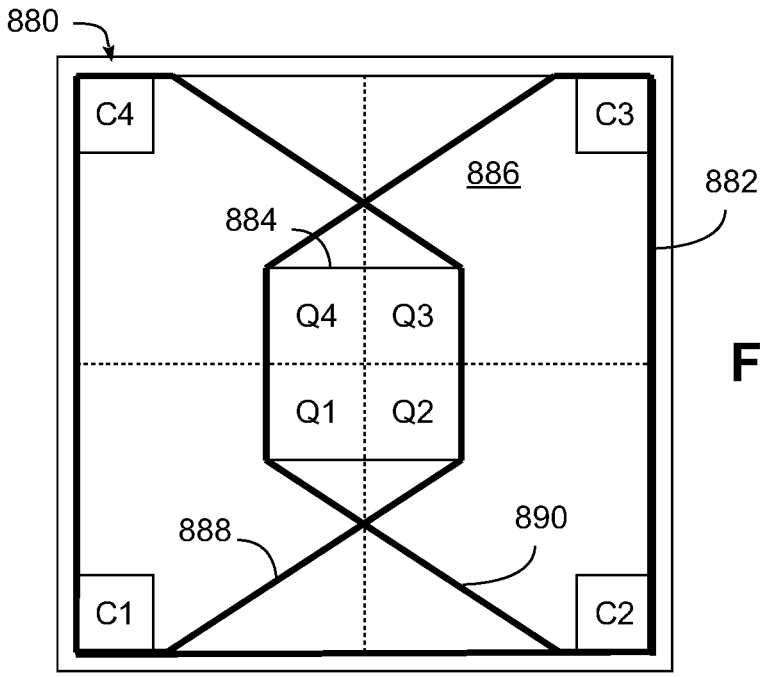
FIG. 18 is a top plan view of an example load including an inboard portion, and an example U wrap top layer containment operation performed thereon.

FIGS. 16-18 illustrate various top layer containment operations that may be activated for loads with nonstandard top layers. FIG. 16, for example, illustrates a cross wrap top layer containment operation performed on load 722 of FIG. 7. Load 722 may be considered to include an inboard portion or a ragged topography, and it is assumed that in this instance the thickness of the top layer 732 is determined to be below the threshold at which a U wrap top layer containment operation is used.

With this cross wrap top layer containment operation, two revolutions of a cross wrap sequence are illustrated, with a first revolution applying packaging material identified at 746. In this revolution, a web of packaging material engages corner C1 of a first pair of opposing corners (C1 and C3), after which the elevation of the web increases such that the web passes inwardly of corner C2. The elevation of the web is then decreased such that the web engages corner C3, after which the elevation of the web increases such that the web passes inwardly of corner C4. The elevation of the web is then decreased such that the web again engages corner C1, with portions of the web of packaging material overlapping or engaging a top surface 736 of main body 726, side surfaces of one or more cartons 734 in top layer 732 and/or top surfaces 738 of cartons 734 in top layer 732. In a second revolution, which may begin 90 degrees, 270 degrees, 450 degrees, etc. after the completion of the first revolution, another cross wrap sequence is performed, but starting at a corner from the other pair of opposing corners (i.e., corner C2 or C4) to apply packaging material identified at 748. Assuming, for example, that the second revolution begins 90 degrees after the first revolution, during the 90 degrees of rotation, the elevation of the web may be held at substantially the same elevation to enable the web to wrap around the side of the load and engage corner C2. Thereafter, the elevation of the web is increased such that the web passes inwardly of corner C3, then the elevation is decreased such that the web engages corner C4, then the elevation of the web is increased such that the web passes inwardly of corner C1, and then the elevation is decreased such that the web again engages corner C2, with portions of the web again overlapping or engaging a top surface 736 of main body 726, side surfaces of one or more cartons 734 in top layer 732 and/or top surfaces 738 of cartons 734 in top layer 732.

FIG. 17 illustrates a cross wrap top layer containment operation performed on a load 870 including an easily deformable top layer 872 in the form of a load of uncartoned paper towels, as well as including a slip sheet 874 disposed on a top surface of the load. First and second revolutions of packaging material identified at 876, 878 are applied in the cross wrap top layer containment operation in a similar manner to packaging material 746, 748 of load 722 of FIG. 16, but it will be appreciated that for load 870, the packaging material passes entirely inwardly of each corner and is wrapped around the sides of the load at a lower elevation such that the packaging material is offset from the intersections of the top surface and sides of the load to avoid subjecting the areas proximate corners C1-C4 to reduced compressional forces. Nonetheless, the packaging material still secures slip sheet 874 to the load.

FIG. 18 illustrates a U wrap top layer containment operation performed on a load 880 including a main body 882 and an inboard portion 884 positioned on a top surface 886 thereof. It is assumed that in this instance the thickness of the inboard portion 884 is determined to be above the threshold at which a U wrap top layer containment operation is used. Main body 882 is illustrated with four corners C1-C4, with inboard portion 884 having four quadrants Q1-Q4 associated with the respective corners C1-C4.

With this U wrap top layer containment operation, two revolutions of a U wrap sequence are illustrated, with a first revolution applying packaging material identified at 888. In this revolution, a web of packaging material engages corner C1, after which the elevation of the web increases such that the web passes inwardly of corners C2 and C3 to engage inboard portion 884 within each of quadrants Q2 and Q3. Thereafter, the elevation of the web is decreased such that the web engages corner C4, after which the elevation of the web is maintained at a level such that the web again engages corner C1. In a second revolution, which may begin, for example, 180 degrees after the completion of the first revolution, another U wrap sequence may be performed to apply the packaging material identified at 890, but starting at corner C3. In this revolution, the web engages corner C3, after which the elevation of the web increases such that the web passes inwardly of corners C4 and C1 to engage inboard portion 884 within each of quadrants Q4 and Q1. Thereafter, the elevation of the web is decreased such that the web engages corner C2, after which the elevation of the web is maintained at a level such that the web again engages corner C3.

As discussed in the aforementioned cross-referenced applications, control of the elevation of a web may be based upon movement of an elevator or carriage supporting at least a portion of a packaging material dispenser, engagement of a roping mechanism to fully or partially narrow the web from the top and/or bottom edge, changing the orientation or tilt of the web, and other manners that would be apparent to one of ordinary skill in the art having the benefit of the instant disclosure. Further, the control may be used for functional purposes, e.g., to contain a particular size or type of inboard load or top surface topography, as well as for aesthetic purposes, e.g., to provide a symmetrical wrapping pattern around all four sides of the load.

Furthermore, various control parameters may be used to control the placement of the web for functional and/or aesthetic concerns. For example, control of the elevation of a web to position the web in desired position(s) on a load may be based upon the elevation of the web, the rate of change of the elevation of the web (e.g., the speed of an elevator), the timing of when changes in the elevation of the web occur and/or the separation between corners (e.g., based upon the length (L) and/or width (W) of the load and/or any offset in the load from a center of rotation). For example, the timing may be based upon a sensed rotational angle between a packaging material dispenser and a load (e.g., using a rotary encoder or other angle sensor), or in some embodiments, may be based upon a timer that is triggered at a known rotational position (e.g., a home rotational position) and that is based upon a known rate of rotation (e.g., in RPM). Further, trigonometric principles may be applied to determine, based the elevation of the web after engaging a corner and the desired point of contact between adjacent corners, what the elevation of the web needs to be and when the web needs to reach the desired elevation. It will be appreciated that due to the tackiness of packaging material, a portion of a web that engages a corner will generally adhere to the corner and retain the elevation and angle at which it was applied. Likewise, a portion of a web that wraps over an edge between a side and the top surface of the load will also generally adhere to the side of the load and thereby retain the same elevation and angle at which it was applied. As such, control over the elevation of the web at each of these points of contact with the corner and the edge (as well as corresponding control of the elevation when returning to engage a subsequent corner) may be used to pass the web inwardly of the subsequent corner to a controlled amount.

Further, in some embodiments it may also be desirable to control a wrap force or tension applied to a web of packaging material during a top layer containment operation to optimize containment and reduce the risk of packaging material breaks. For example, it should be appreciated that when a web is increasing in elevation in conjunction with relative rotation, the effective demand of the load increases above the demand during the main portion of a wrapping cycle, and as such, decreasing the wrap force or tension applied to the web of packaging material during an elevation increase in association with passing inwardly of a corner may offset the increased demand. Likewise, increasing the wrap force or tension applied to the web of packaging material during an elevation decrease after passing inwardly of a corner may offset a decrease in demand occurring due to the lowering of the elevation of the web. In some embodiments, for example, it may be desirable to temporarily increase and/or decrease a wrap force relative to a wrap force parameter that is used to control the wrap force during the main portion of a wrapping cycle. It will also be appreciated that control over a wrap force or tension may also be handled by changing a dispense rate of a packaging material dispenser, as dispense rate is generally inversely proportional to the tension in a web of packaging material during a wrapping operation.

Figure 19:
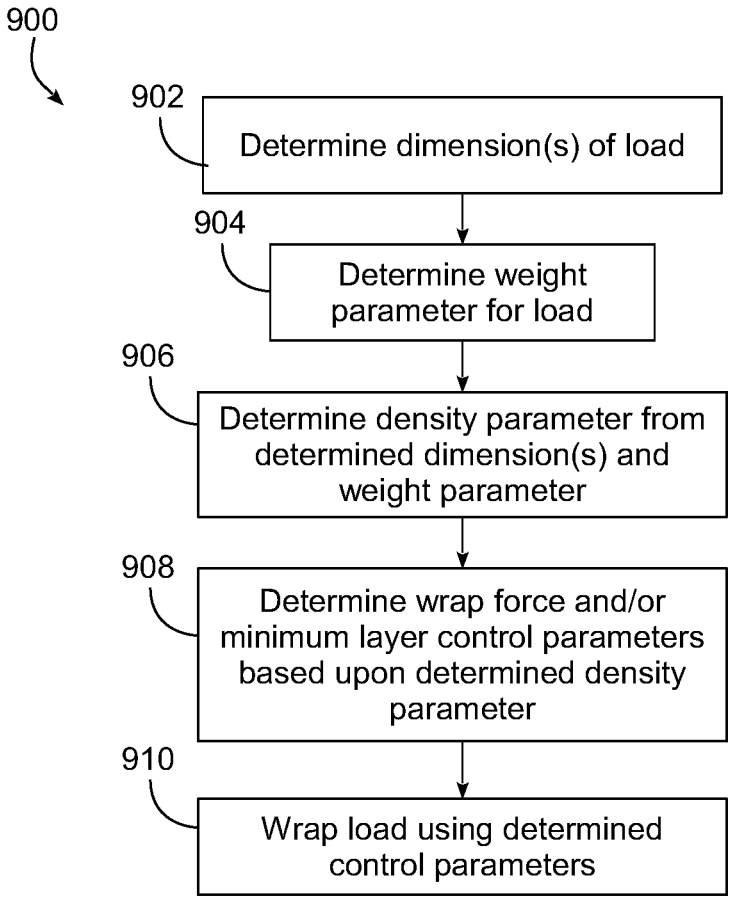
FIG. 19 is a flowchart illustrating an example sequence of operations for wrapping a load based upon a density parameter consistent with the invention.
Figure 20:
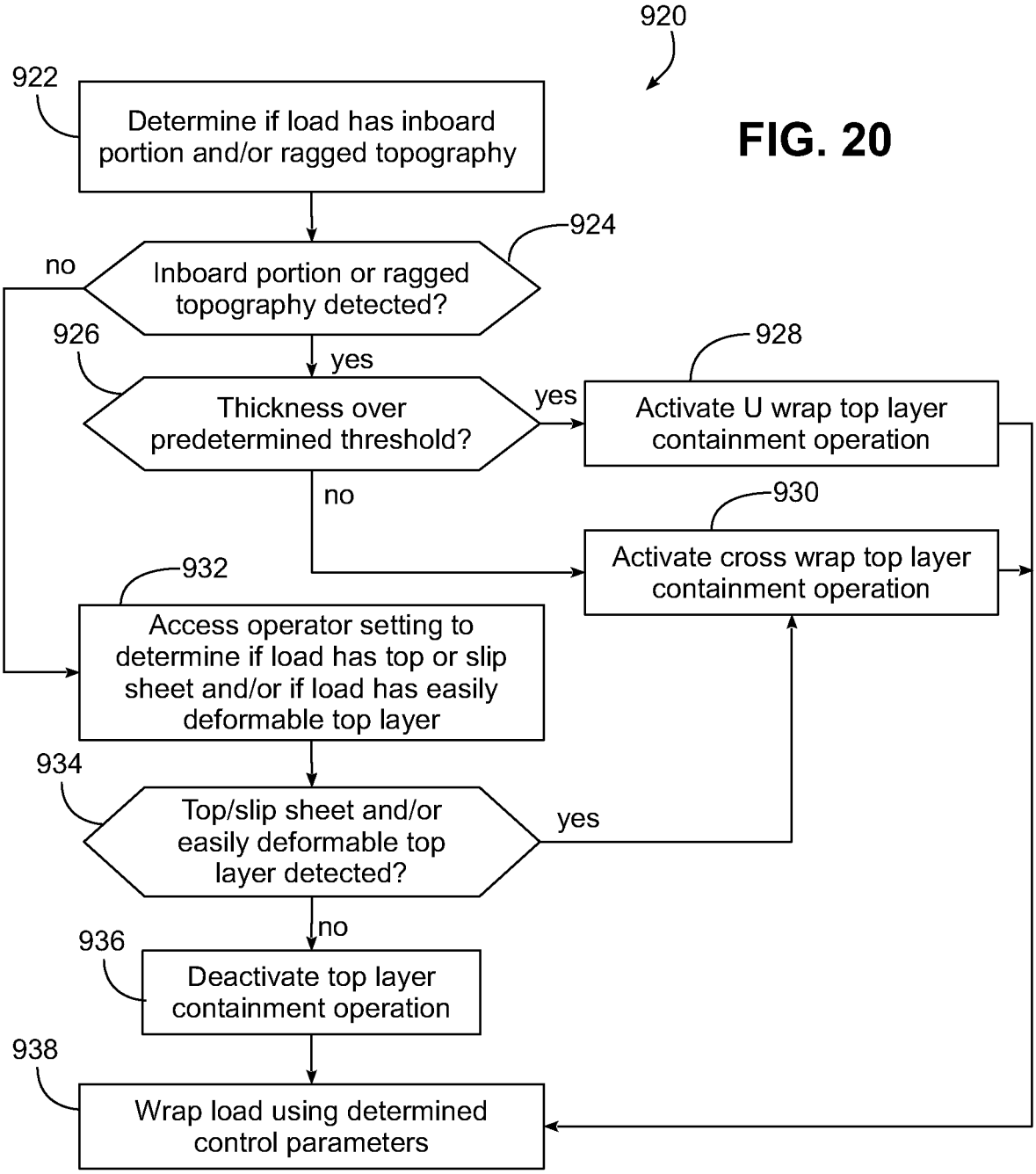
FIG. 20 is a flowchart illustrating an example sequence of operations for wrapping a load using a top layer containment operation consistent with the invention.

Now turning to FIGS. 19-20, as discussed above, automatic load profiling consistent with the invention may be based upon data other than data collected from a three-dimensional scanning sensor, and in fact, may in some embodiments be based at least in part on data other than sensed data. As an example, FIG. 19 illustrates at 900 an example sequence of operations for controlling a wrapping operation based on a density parameter, and doing so in an automated manner that does not rely on operator input. In block 902, the dimension(s) of a load may be determined, e.g., via sensing the dimensions in any of the manners discussed above, via retrieval from a database or an external device, via receiving operator input, etc. In block 904, a weight parameter for the load may be determined, e.g., via a weight sensor, via a sensing of relative weight, via retrieval from a database or an external device, via receiving operator input, etc. From the determined dimension(s) and weight parameter, a density parameter may then be determined in block 906, in any of the manners described above. In one embodiment, for example, the density parameter may be calculated as a ratio of load weight to overall load height to determine a value in units of lbs/inch. In another embodiment, a volume may be calculated for the load, e.g., based upon overall length, width and height, or based upon a volumetric analysis that determines or approximates the overall volume of a non-cuboid shaped load, and a ratio may be taken between the load weight and the calculated volume. In still another embodiment, a density parameter may be based on a relative weight and/or one or more relative dimensions or volumes, as discussed above.

After the density parameter is determined, block 908 determines wrap force and/or minimum layer control parameters based on the density parameter, and in block 910 the load is wrapped using the determined control parameters. As noted above, the control parameters that may be controlled may vary based upon the type of wrapping machine and wrapping technology employed. Further, it may be seen in this figure that the load may in some embodiments be wrapped in a fully automated fashion and without operator input.

FIG. 20 next illustrates at 920 an example sequence of operations for selectively activating a top layer containment operation during a wrapping operation. It is assumed for the purposes of this figure that an inboard portion may be detected and a top layer containment operation may be activated after a wrapping operation has already been initiated and the elevation of the packaging material dispenser is increasing from a lowered position while applying packaging material in a spiral fashion around the sides of the load. In addition, it is assumed that the presence of an inboard portion and/or ragged topography on a load is determined based upon sensing one or more elevations of a load using one or more sensors that are operatively coupled to change in elevation with the packaging material dispenser, as discussed above in connection with FIGS. 5 and 6A-6B, or in other manners discussed above.

Block 922 may first determine from the surface model whether a load has an inboard portion and/or ragged topography, i.e., whether the load includes an incomplete top layer that is substantially inboard of a main body of a load, whether the load includes a product that is substantially inboard of a pallet, or whether the load has a top layer with varying elevations, e.g., in the manner discussed above in connection with FIGS. 5 and 6A-6B. If an inboard portion or ragged topography is detected, block 924 passes control to block 926 to determine whether the thickness of the inboard portion/top layer is above a predetermined threshold. If so, block 926 passes control to block 928 to activate a U wrap top layer containment operation, and if not, block 926 passes control to block 930 to activate a cross wrap top layer containment operation. Returning to block 924, if no inboard portion or ragged topography is detected, block 924 passes control to block 932 to determine if the load has a top or slip sheet and/or if the load has an easily deformable top layer. Block 932 may make the determination in this embodiment, for example, based upon operator input or input from an upstream or other external device (e.g., based upon a signal from a machine that places a slip sheet on the load, based upon a database record associated with the load and indicating a deformable product type, etc.).

If either of such nonstandard top layer is determined to be present on the load, block 934 passes control to block 930 to activate the cross wrap top layer containment operation. Otherwise, block 934 passes control to block 936 to deactivate all top layer containment operations, such that the load will be wrapped using a traditional, spiral wrapping operation with no additional packaging material wrapped over a top surface of the load. Upon completion of any of blocks 928, 930 and 936, control passes to block 938 to continue wrapping the load using the determined control parameters, and performing any activated top layer containment operation at an appropriate point in the wrapping cycle.

Figure 22:
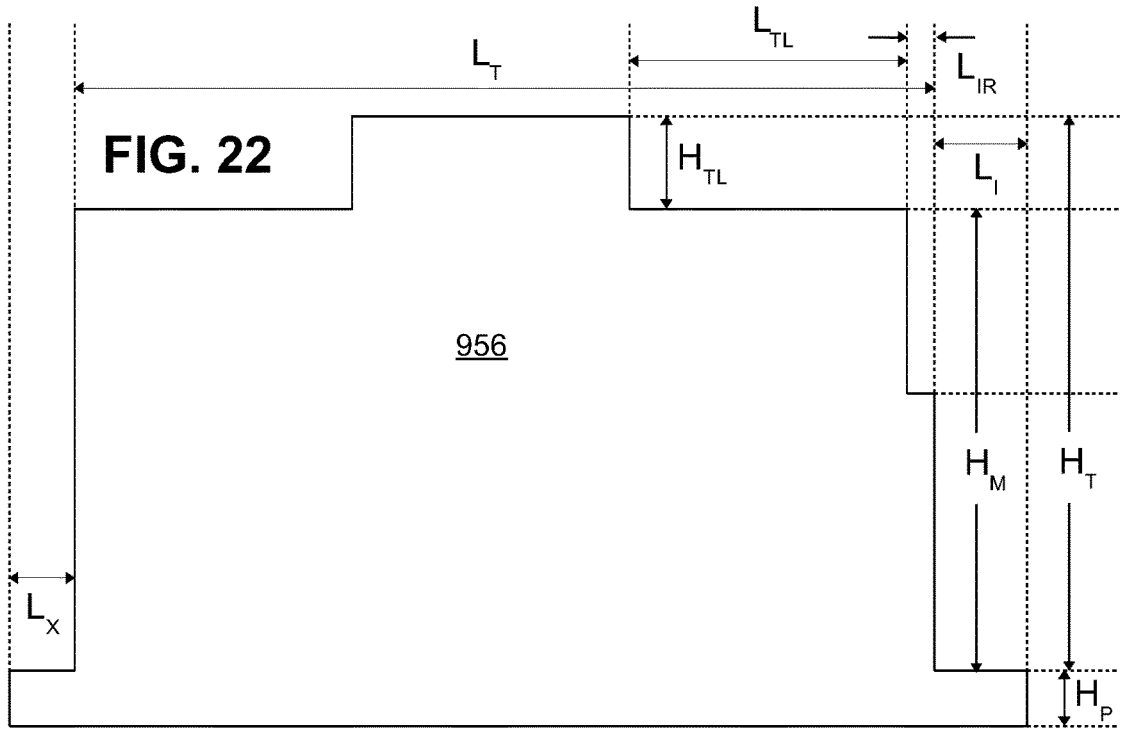
FIG. 22 is a side elevational view of an example surface model generated for the example load of FIG. 21.
Figure 23:
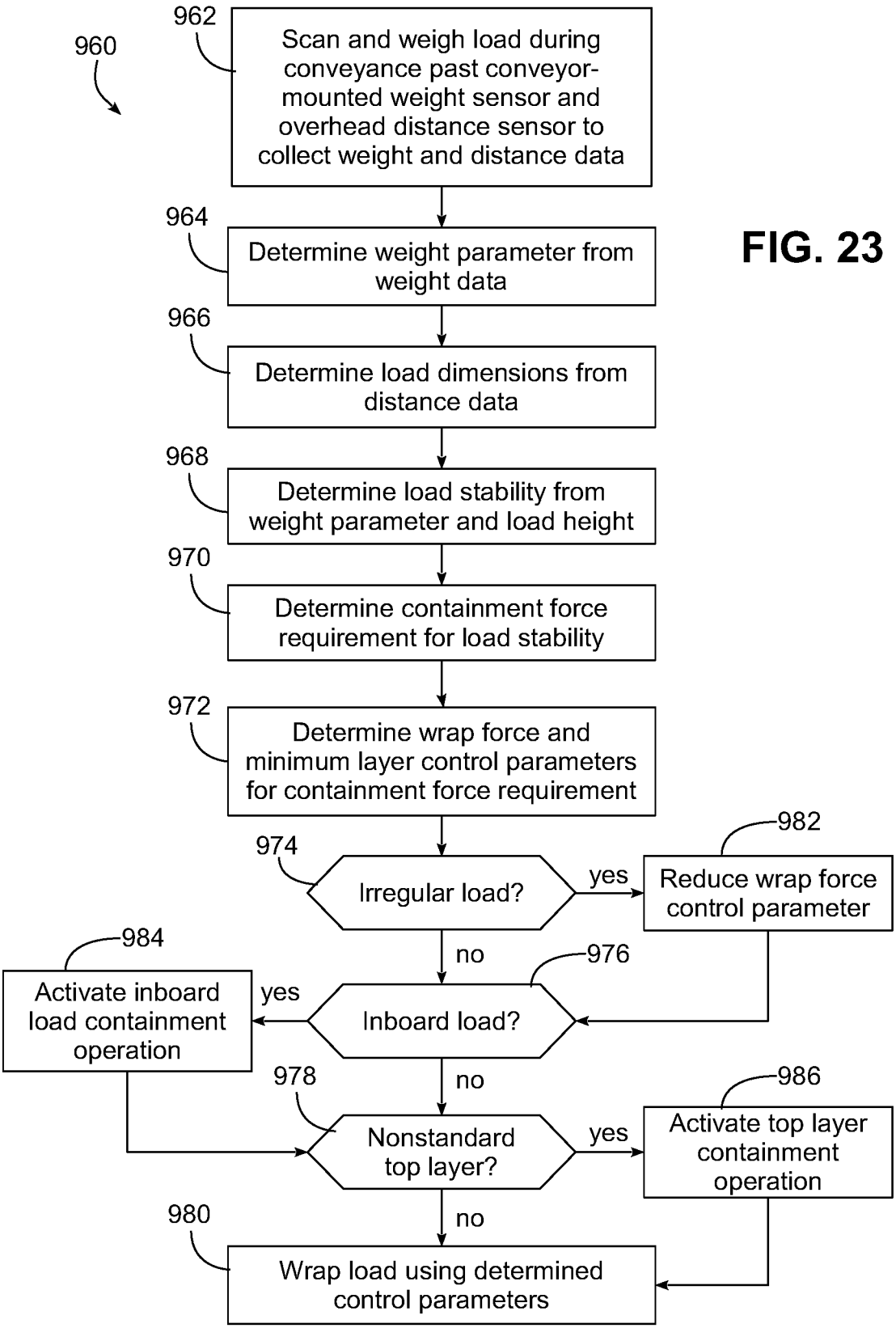
FIG. 23 is a flowchart illustrating an example sequence of operations for wrapping a load using the sensors of FIG. 21.

FIGS. 21-23 next illustrate another embodiment of automatic load profiling consistent with the invention, and utilizing a distance sensor and weight sensor to generate a load profile during conveyance of the load along a conveyor. Specifically, FIG. 21 illustrates an example load 940 with a plurality of cartons 942 arranged into a plurality of layers (here, six layers) and supported on a pallet 944. The bottom five layers of the load are complete layers, and define a main body 946 of the load, while the top layer is incomplete, such that the load also includes an inboard portion 948.

In addition, it may be seen that the bottom five layers of load 940 are not perfectly aligned, such that the main body 946 does not have substantially planar vertical sides. As such, load 940 may be considered to be an irregular load.

Load 940 may be conveyed to a wrapping machine on a conveyor 950, and an overhead distance sensor 952 may be positioned to sense a distance to the nearest surface opposing the sensor along a generally vertical axis as load 940 is conveyed past the sensor, and to generate distance data representative of such distance. In addition, a weight sensor 954, e.g., a load cell mounted to a side rail of the conveyor, may be used to generate weight data indicative of the weight of the load. It will be appreciated that while distance sensor 952 and weight sensor 954 may respectively generate actual distances and weights, in some embodiments, only relative distances and/or relative weights may be generated. For example, weight sensor 954 may only generate a signal that is proportional to weight such that the signal may be used to determine whether a load is within one of a plurality of weight categories such as "very light," "light," "normal," "heavy," and "very heavy," or other suitable ranges.

As load 940 is conveyed along conveyor 950, distance sensor 952 collects distance data that may be associated with a time stamp, such that with a known conveyor speed, the time may be converted to a length or distance in the direction along which the load is conveyed by the conveyor. As shown in FIG. 21, for example, times to represents the time at which the leading edge of pallet 944 is first detected by sensor 952, while times $t_1$-$t_6$ represent times at which transitions between upwardly-facing surfaces of load 940 are detected, with the corresponding distances $d_0$-$d_6$ from the sensor measured at those times.

In some embodiments, for example, detection of a change in distance sensed by sensor 952 from the distance to the conveyor surface (do) may trigger data collection over a sample window until the distance sensed by sensor 952 returns to the distance to the conveyor surface, and distance data points may be collected at preset intervals. In some embodiments, only the data points corresponding to changes in detected distances may be retained, such that the load may be characterized by the distances detected at the times corresponding to the detected changes. In addition, in some embodiments, during this sample window one or more weight sensor data points may be collected to determine a weight parameter for the load. The weight parameter may be determined from a single data point, or from multiple data points (e.g., via averaging, via selecting the maximum data point, etc.)

FIG. 22 illustrates an example surface model 956 that may be generated for load 940, representing the changes in elevation sensed by sensor 952 of FIG. 21. Based upon the measured distances, for example, a number of heights or elevations on the load may be detected, e.g., a total height for the load ($H_T$, $d_c$-$d_3$), a height of the main body ($H_M$, $d_c$-$d_2$), a height of the pallet ($H_P$, $d_c$-$d_0$) and a height of the inboard portion or top layer ($H_{TL}$, $d_2$-$d_3$), among others. In addition, by converting the time durations between the various time stamps $t_0$-$t_6$ to distances based upon conveyor velocity v (e.g., in inches/second), various lengths along the direction of conveyance may be determined, e.g., a total length ($L_T$, $v(t_5-t_1)$) corresponding to an overall length of the load, an inboard length ($L_I$, $v(t_1-t_0)$) corresponding to the distance the main body of the load is inboard of the pallet, an irregularity length ($L_{IR}$, $v(t_2-t_1)$) corresponding to the amount of irregularity in the leading side of the load (i.e., the degree to which the leading side is non-vertical and/or non-planar), and a top layer offset length ($L_{TL}$, $v(t_3-t_2)$) corresponding to the distance to which the top layer of the load is inboard of the main body. It will be appreciated that additional dimensions of the load may also be determined, e.g., based upon the trailing side of the load depicted on the left side of FIGS. 21 and 22.

Furthermore, in some embodiments it may be desirable to analyze both the leading and trailing sides of the load to detect irregularity and/or how far inboard a main body of a load is on a pallet. As shown in FIG. 21, for example, since the fifth layer of cartons 942 in main body 946 of load 940 is shifted towards the left of FIG. 21 relative to the other layers, the surface model 956 of FIG. 22 does not include the irregularity in the trailing side of the load (i.e., the trailing side appears to be planar and vertical), nor does the distance from the trailing side to the trailing side of the pallet ($L_X$, $v(t_6-t_5)$), accurately reflect the degree to which the main body is inward of the pallet.

Now turning to FIG. 23, this figure illustrates at 960 a sequence of operations for automatically profiling and wrapping a load using the sensor configuration of FIG. 21. It is assumed for the purposes of this sequence that a load is being conveyed to a wrapping machine via conveyor 950, and as such, at block 962, the load is scanned and weighed while being conveyed past the conveyor-mounted weight sensor 954 and overhead distance sensor 952 to collect weight and distance data for the load. Next, in block 964, a weight parameter, e.g., an actual weight or a relative weight, may be determined from the weight data, and in block 966, one or more load dimensions may be determined from the distance data. In some embodiments, for example, a weight parameter may be determined as a relative weight that categorizes the load into one of a plurality of weight ranges, and the load dimensions that are determined may include at least a total height of the load, an amount a main body of the load is inboard of the pallet, an amount of irregularity in one or more vertical sides of the load, and an indication of whether the load has an inboard portion.

Next, in block 968, a stability of the load may be determined from the weight parameter and the total height of the load, and then in block 970, a containment force requirement for the load may be determined from the determined stability. For example, in some embodiments, based on the height and the weight parameter, a density parameter representing stability may be calculated (e.g., as the ratio of the weight parameter to height), and the density parameter may be mapped to one of a plurality of containment force requirements, e.g., using a lookup table. In other embodiments, different load stability types may be defined such as a light stable load type, a light unstable load type, a heavy stable load type, and a heavy unstable load type, with each type associated with a containment force requirement, and one of the load stability types may be selected based upon the weight parameter and the height. In still other embodiments, a formula may be used to select a load stability type or directly calculate a containment force requirement from a height and weight parameter. Such a formula may be determined empirically in some embodiments based upon testing of loads with different height and weight combinations. Other variations such as those discussed above may also be used in other embodiments.

Based upon the determined containment force requirement, block 972 then calculates a wrap force and minimum layer control parameters for use in wrapping the load, e.g., in any of the manners disclosed in the aforementioned U.S. Patent Application Publication No. 2014/0223864. The control parameters may be stored in a wrap profile, which in some embodiments may be stored for later access and/or modification by an operator, while in other embodiments may be used to wrap the load with no operator input.

Blocks 974, 976 and 978 next test for three different special circumstances that may be used to trigger a modification of the wrap profile prior to wrapping the load in block 980. If none of these circumstances are detected, blocks 974, 976 and 978 pass control directly to block 980 to wrap the load using the determined control parameters in the wrap profile.

Block 974 determines whether the load is an irregular load, e.g., based upon the detection of a non-vertical and/or non-planar side of the load. It will be appreciated that if the load is irregular, greater fluctuations in demand and effective girth may occur during wrapping, resulting in an increased risk of packaging material breaks. As such, it may be desirable when an irregular load is detected in block 974 to pass control to block 982 to reduce the wrap force control parameter, e.g., by a fixed percentage or alternatively by a percentage that varies based upon the amount of irregularity detected in the load. In addition, based upon the reduction in the wrap force control parameter, one or more layers may be added to compensate for the corresponding decrease in containment force applied to the load, such that the combination of the wrap force parameter and the layer parameter continues to meet the containment force requirement for the load.

Block 976 determines whether the load is an inboard load, e.g., based upon detection of an inboard length ($L_I$) above a threshold. It will be appreciated that if the load is inboard to the pallet, the girth of the pallet is larger than that of the load, so a wrap around the pallet may have a higher risk of tearing the packaging material at the corners of the pallet due to the higher wrap force encountered at those corners. As such, it may be desirable when an inboard load is detected in block 976 to pass control to block 984 to activate an inboard load containment operation in the wrap profile to reduce the wrap force when wrapping around the pallet and/or increase the number of layers around or near the pallet to account for the different girths of the pallet and the load. For example, it may be desirable for a moderately inboard load (e.g., between about 1-3 inches) to activate an inboard load containment operation that reduces the wrap force parameter by a fixed percentage when wrapping around the pallet, and for an extremely inboard load (e.g., greater than about 3 inches) to activate an inboard load containment operation that reduces the wrap force parameter by the same or additional amount when wrapping around the pallet, coupled with applying an additional band of packaging material around the load just above the pallet (and generally using the wrap force control parameter used to wrap the rest of the load).

Block 978 determines whether the load has a nonstandard top layer, e.g., based upon detection of a top layer that is inboard of a main body of the load. If so, block 978 passes control to block 986 to activate an appropriate top layer containment operation (e.g., to select a U wrap or cross wrap sequence based upon a height of the top layer of the load).

Blocks 982, 984 and 986 may each therefore modify the wrap profile to be used for wrapping the load, e.g., by modifying one or more control parameters and/or activating a particular operation during wrapping. Upon completion of any of blocks 982, 984 or 986, control passes to block 980 to wrap the load using the wrap profile using the modifications made thereto.

It will be appreciated that any of the circumstances detected in blocks 974, 976 and 978 may be omitted in some embodiments. For example, in some embodiments, detection of nonstandard top layers may be omitted such that only irregular loads and inboard loads are the only special circumstances detected prior to wrapping.

Load Stability

Figure 24:
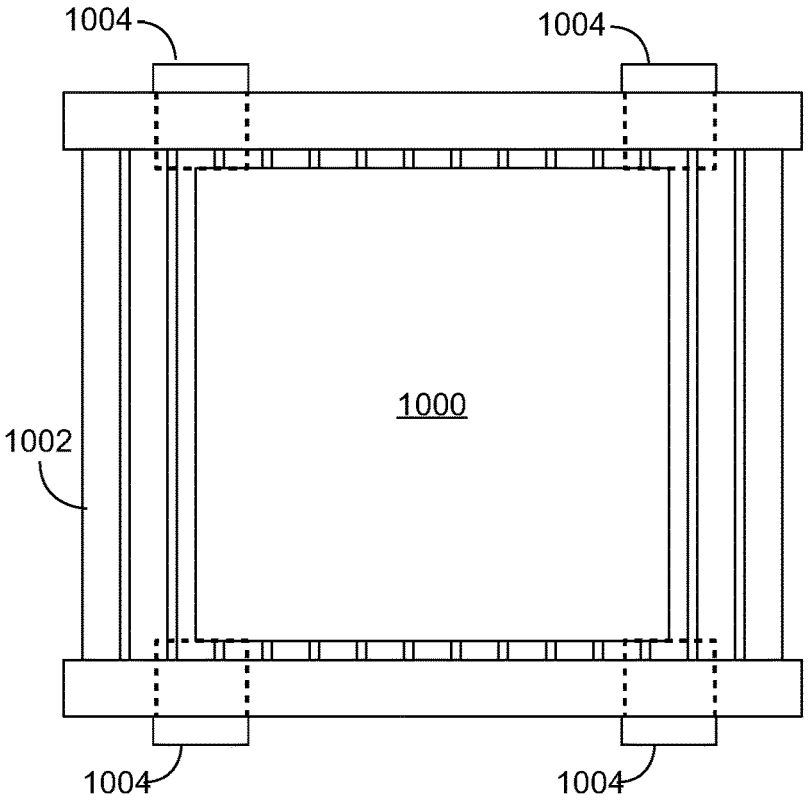
FIG. 24 is a functional top plan view of an example load supported on a conveyor, and illustrating positioning of example force sensors relative thereto for the purpose of determining load stability.
Figure 25:
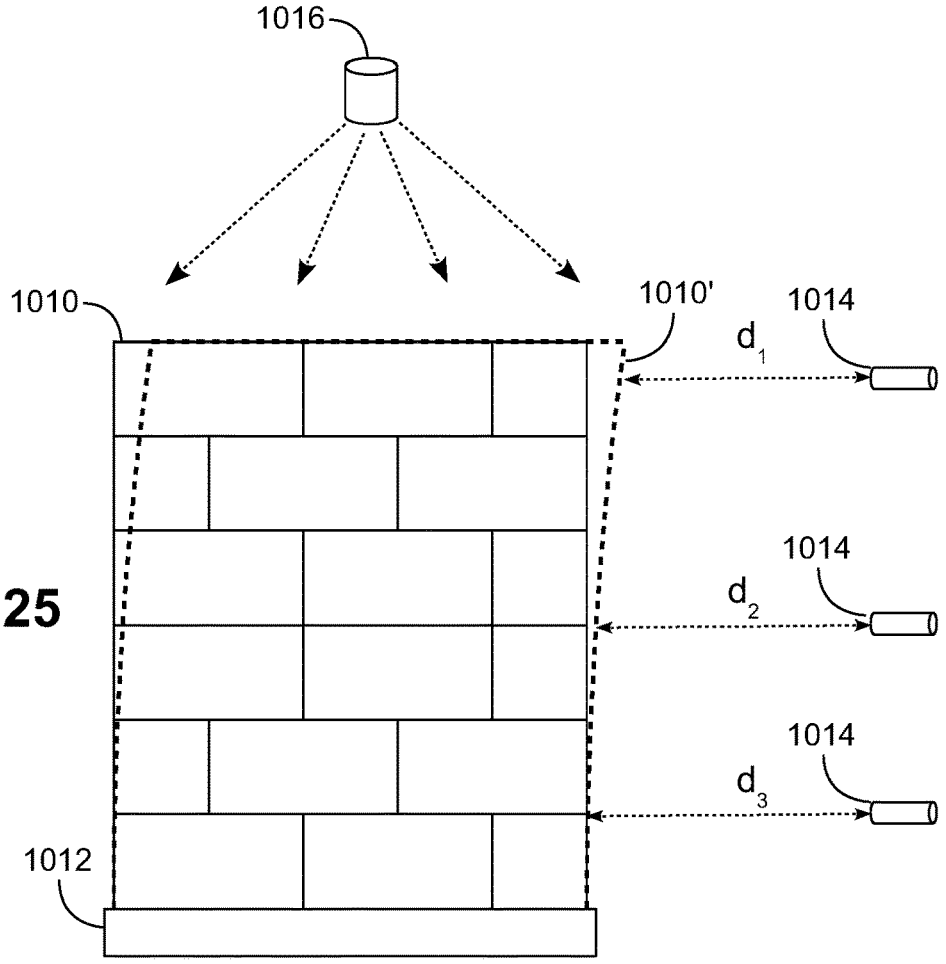
FIG. 25 is a functional side elevational view of an example load, and illustrating positioning of example image and distance sensors relative thereto for the purpose of determining load stability.
Figure 26:
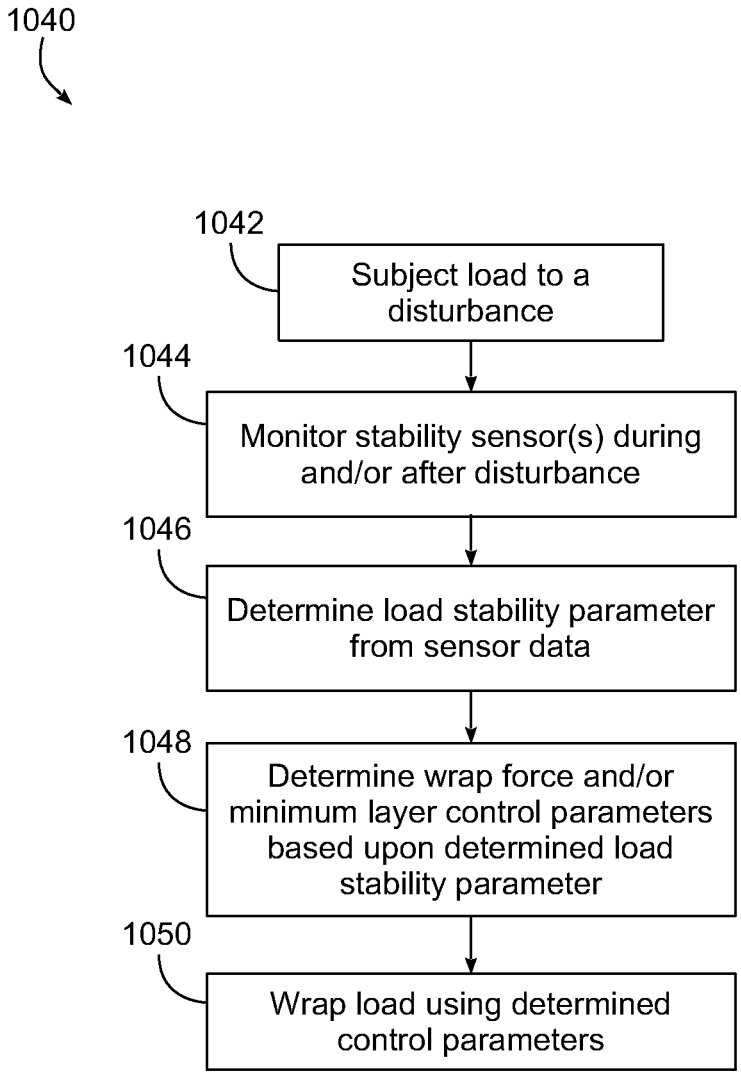
FIG. 26 is a flowchart illustrating an example sequence of operations for wrapping a load based upon a load stability parameter consistent with the invention.

Now turning to FIGS. 24-26, as noted above a stability parameter may be determined in some embodiments using one or more sensors capable of sensing the reaction of a load to various types of input forces that are indicative of load stability.

It will be appreciated that load stability may be affected by a number of factors related to the dimensions and/or contents of a load. For example, load stability may be impacted in some instances by the footprints or dimensions of the packages or cases in a load relative to the overall height of the load. Load stability may also be impacted by load contents, e.g., partially-filled liquid containers, springy or compressible type products (e.g., diapers vs. bags of flour), etc. Load stability may also be impacted by the amount of friction between layers, the use of interleaving sheets between layers, the overall height of the pallet supporting the load, etc.

To sense load stability in some embodiments, a load may be subjected to a force, impulse, sudden change in momentum or other disturbance so that the reaction of the load thereto can be sensed. In some embodiments, for example, a load may be shaken, tilted, impacted or pushed and the response of the load measured in response thereto. The response, for example, may be based upon movement of the load over time, changes in rocking forces over time, etc.

In some embodiments, for example, a load may be conveyed to a wrapping machine on a conveyor, and the reaction of the load to starting or stopping the conveyor may be monitored. As such, in some embodiments, the disturbance being monitored does not need to be separately induced, or require the use of dedicated machinery. In addition, where a turntable is used, sudden starting or stopping of a turntable may be used to disturb the load. In other embodiments, specific operations and/or components may be used to induce a disturbance. For example, it may be desirable in some embodiments to "push" or impact the side of a load to induce lateral rocking of the load, to "tip", lift or tilt a conveyor or other load support to rock the load, or to vibrate or otherwise shake the load through vibration or orbital motion. It will be appreciated that in each of these instances, it may also be desirable to maintain the magnitude of the disturbance of the load below that which causes shifting or displacement of the contents of the load prior to wrapping. In some embodiments, this magnitude may vary depending upon other characteristics of the load (e.g., heavier and/or shorter loads may be subjected to higher magnitude disturbances).

Sensing of the load reaction to a disturbance may also be implemented in a number of manners in different embodiments. For example, as illustrated in FIG. 24, a disturbance applied to a load 1000, e.g., due to sudden stopping or starting of a conveyor 1002 upon which the load 1000 is supported, may be sensed by multiple force sensors such as load cells 1004 positioned proximate edges or corners of the footprint of load 1000. It will be appreciated that load cells 1004 will generally have varying responses to the disturbance as the load rocks immediately after the conveyor starts or stops, and as such, a comparison of the different responses may be used to characterize the stability of load 1000. It will also be appreciated that in such an embodiment, load cells 1004 may also be used to sense the weight of the load, such that both weight and stability may be used to characterize a load.

As another example, as shown in FIG. 25, stability of a load 1010 disposed on a pallet 1012 may be sensed using various types of sensors capable of sensing movement of the load or of portions of the load. As one example, one or more distance sensors 1014 may be positioned at one or more elevations to sense deflection of load 1010 (illustrated at 1010') after a disturbance. As another example, an image sensor 1016 (shown above the load but also capable of being positioned at the side or in other positions relative to the load) may be used in addition to or in lieu of sensors 1014 to monitor movement of load 1010 after a disturbance. It will be appreciated that a more stable load will generally exhibit less deflection in response to a disturbance of a given magnitude than a less stable load, so greater load deflection may be an indication of lower load stability in some embodiments.

It will be appreciated that any of sensors 1004, 1014 and 1016 may be used separately or in combination in different embodiments, and that different numbers and/or positions of such sensors may be used in different embodiments. Other sensors capable of sensing the reaction of a load to a disturbance may be used in other embodiments as well.

As discussed above, automatic load profiling consistent with the invention may be based upon load stability, optionally in combination with other determined load characteristics. FIG. 26 for example illustrates at 1040 an example sequence of operations for controlling a wrapping operation based on a load stability parameter, and doing so in an automated manner that does not rely on operator input. In block 1042, the load may be subjected to a disturbance, e.g., via shaking, pushing, tilting, lifting, starting, stopping, etc. in any of the manners discussed above. In block 1044, one or more stability sensors may be monitored after the disturbance, and in block 1046 a load stability parameter may be determined based upon the sensor data.

After the load stability parameter is determined, block 1048 determines wrap force and/or minimum layer control parameters based on the load stability parameter, and in block 1050 the load is wrapped using the determined control parameters. As noted above, the control parameters that may be controlled may vary based upon the type of wrapping machine and wrapping technology employed. Further, it may be seen in this figure that the load may in some embodiments be wrapped in a fully automated fashion and without operator input.

A load stability parameter, similar to other load characteristics describe above, may be numerical, may be based upon a particular dimension or may be dimensionless, or may be simply a category among a plurality of categories. Load stability may be determined in different manners based upon the type of sensor(s) used and optionally other load characteristics. In one example embodiment, sensor data may be evaluated to determine one or more of a maximum value (e.g., the maximum amount of movement detected), a frequency value (e.g., the rate of oscillation of movement), a time or decay-related value (e.g., how quickly load oscillation of movement dissipates), or other values associated with the reaction of a load to a disturbance. Thus, for example, a load that reacts to a disturbance by deforming or moving a small amount and only doing so for a small number of oscillations may be determined to have greater stability than another load that deflects a large amount and/or oscillates for a longer period of time.

Other embodiments will be apparent to those skilled in the art from consideration of the specification and practice of the present invention. Therefore the invention lies in the claims set forth hereinafter.

What is claimed is:

1. A method of controlling a load wrapping apparatus of a type configured to wrap a load on a load support with packaging material dispensed from a packaging material dispenser through relative rotation between the packaging material dispenser and the load support, the method comprising:

determining a density parameter for the load prior to wrapping the load, the density parameter describing a characteristic of the load prior to wrapping that is based on a relationship between a size of the load and a weight of the load; and controlling one or more control parameters for the load wrapping apparatus when wrapping the load based upon the determined density parameter for the load, wherein controlling the one or more control parameters for the load wrapping apparatus when wrapping the load based upon the determined density parameter for the load includes determining a stability for the load based upon the determined density parameter.

2. The method of claim 1, wherein controlling the one or more control parameters for the load wrapping apparatus when wrapping the load based upon the determined density parameter for the load includes determining a containment force requirement for the load based upon the determined density parameter.

3. The method of claim 1, wherein controlling the one or more control parameters for the load wrapping apparatus when wrapping the load based upon the determined density parameter for the load includes determining a wrap force or a number of layers of packaging material to be applied to the load based upon the determined density parameter.

4. The method of claim 1, further comprising:

sensing a plurality of points on a plurality of surfaces of the load using one or more sensors directed at the load and generating a surface model of the load based upon the sensed plurality of points; and determining a verticality of at least one side of the load based upon the generated surface model.

5. The method of claim 1, wherein controlling the one or more control parameters for the load wrapping apparatus when wrapping the load based upon the determined density parameter for the load includes selecting or configuring a wrap profile for the load based upon the determined density parameter for the load.

6. A method of controlling a load wrapping apparatus of a type configured to wrap a load on a load support with packaging material dispensed from a packaging material dispenser through relative rotation between the packaging material dispenser and the load support, the method comprising:

determining a dimension of the load;

determining a density parameter for the load prior to wrapping the load using the determined dimension of the load, the density parameter describing a characteristic of the load prior to wrapping that is based on a relationship between a size of the load and a weight of the load, wherein determining the density parameter for the load includes calculating a ratio between the determined dimension of the load and the weight of the load; and controlling one or more control parameters for the load wrapping apparatus when wrapping the load based upon the determined density parameter for the load.

7. The method of claim 6, further comprising determining a weight parameter of the load, wherein determining the density parameter includes determining the density parameter using the weight parameter.

8. The method of claim 7, wherein determining the weight parameter of the load includes measuring a weight of the load using a weight sensor.

9. The method of claim 7, wherein determining the dimension of the load includes determining a volume of the load from a length, a width and a height of the load.

10. The method of claim 9, wherein the load includes an inboard portion, and wherein determining the volume from the length, the width and the height of the load includes determining the volume from a plurality of lengths, widths and heights of the load.

11. The method of claim 10, further comprising sensing a plurality of points on a plurality of surfaces of the load using one or more sensors directed at the load and generating a surface model of the load based upon the sensed plurality of points, wherein the generated surface model identifies a top surface topography comprising a plurality of elevations for the load, and wherein determining the volume includes determining the volume based upon the generated surface model.

12. The method of claim 11, wherein the one or more sensors includes a digital camera, a range imaging sensor or a three-dimensional scanning sensor.

13. The method of claim 11, wherein the one or more sensors includes first and second height sensors operatively coupled for substantially vertical movement with the packaging material dispenser and respectively configured to detect elevations for a main body and an inboard portion of the load.

14. The method of claim 7, wherein determining the dimension of the load includes determining the height of the load.

15. The method of claim 6, wherein controlling the one or more control parameters for the load wrapping apparatus when wrapping the load based upon the determined density parameter for the load includes determining a containment force requirement for the load based upon the determined density parameter.

16. The method of claim 6, wherein controlling the one or more control parameters for the load wrapping apparatus when wrapping the load based upon the determined density parameter for the load includes determining a wrap force or a number of layers of packaging material to be applied to the load based upon the determined density parameter.

17. The method of claim 6, further comprising:

sensing a plurality of points on a plurality of surfaces of the load using one or more sensors directed at the load and generating a surface model of the load based upon the sensed plurality of points, wherein the generated surface model identifies a top surface topography comprising a plurality of elevations for the load; and determining whether the load has a nonstandard top layer based upon the generated surface model.

18. The method of claim 17, further comprising determining whether the load has an inboard portion based upon the generated surface model.

19. The method of claim 18, further comprising determining dimensions of the inboard portion of the load based upon the generated surface model.

20. The method of claim 17, further comprising activating a top layer containment operation when wrapping the load based upon determining the load has a nonstandard top layer.

21. The method of claim 20, further comprising selecting the activated top layer containment operation from among a plurality of top layer containment operations based upon the generated surface model.

22. The method of claim 21, wherein the plurality of top layer containment operations includes a cross wrap containment operation and a U wrap containment operation.

23. The method of claim 22, wherein selecting the activated top layer containment operation from among the plurality of top layer containment operations includes selecting between the cross wrap containment operation and the U wrap containment operation based upon at least one dimension of an inboard portion of the load determined from the generated surface model.

24. The method of claim 20, further comprising controlling one or more control parameters for the top layer containment operation based upon the generated surface model.

25. The method of claim 24, wherein controlling the one or more control parameters for the top layer containment operation includes controlling one or more of an elevation of a web of packaging material, a width of the web of packaging material, an elevation of an elevator of a packaging material dispenser, a speed of the elevator, an activation state of a roping mechanism, an elevation change start time, an elevation change start angle, or a top edge contact point based upon the generated surface model.

26. The method of claim 6, further comprising:

sensing a plurality of points on a plurality of surfaces of the load using one or more sensors directed at the load and generating a surface model of the load based upon the sensed plurality of points; and determining a verticality of at least one side of the load based upon the generated surface model.

27. The method of claim 6, wherein controlling the one or more control parameters for the load wrapping apparatus when wrapping the load based upon the determined density parameter for the load includes selecting or configuring a wrap profile for the load based upon the determined density parameter for the load.

28. An apparatus for wrapping a load with packaging material, the apparatus comprising:

a packaging material dispenser configured to dispense packaging material to the load;

a drive mechanism configured to provide relative rotation between the packaging material dispenser and the load about an axis of rotation; and a controller coupled to the packaging material dispenser and the drive mechanism, the controller configured to control the load wrapping apparatus by performing a method that includes:

determining a dimension of the load;

determining a density parameter for the load prior to wrapping the load using the determined dimension of the load, the density parameter describing a characteristic of the load prior to wrapping that is based on a relationship between a size of the load and a weight of the load, wherein determining the density parameter for the load includes calculating a ratio between the determined dimension of the load and the weight of the load; and controlling one or more control parameters used when wrapping the load based upon the determined density parameter for the load.

29. The apparatus of claim 28, wherein the controller is further configured to determine a weight parameter of the load, and wherein the controller is configured to determine the density parameter using the weight parameter.

30. The apparatus of claim 29, wherein the controller is configured to determine the weight parameter of the load by measuring a weight of the load using a weight sensor.

31. The apparatus of claim 29, wherein the controller is configured to determine the dimension of the load by determining a volume of the load from a length, a width and a height of the load.

32. The apparatus of claim 31, wherein the load includes an inboard portion, and wherein the controller is configured to determine the volume from the length, the width and the height of the load by determining the volume from a plurality of lengths, widths and heights of the load.

33. The apparatus of claim 32, further comprising one or more sensors directed at the load and configured to sense a plurality of points on a plurality of surfaces of the load, wherein the controller is configured to generate a surface model of the load based upon the sensed plurality of points, wherein the generated surface model identifies a top surface topography comprising a plurality of elevations for the load, and wherein the controller is configured to determine the volume based upon the generated surface model.

34. The apparatus of claim 33, wherein the one or more sensors includes a digital camera, a range imaging sensor or a three-dimensional scanning sensor.

35. The apparatus of claim 33, wherein the one or more sensors includes first and second height sensors operatively coupled for substantially vertical movement with the packaging material dispenser and respectively configured to detect elevations for a main body and an inboard portion of the load.

36. The apparatus of claim 29, wherein the controller is configured to determine the dimension of the load by determining the height of the load.

37. The apparatus of claim 28, wherein the controller is configured to control the one or more control parameters used when wrapping the load based upon the determined density parameter for the load by determining a stability for the load based upon the determined density parameter.

38. The apparatus of claim 28, wherein the controller is configured to control the one or more control the one or more control parameters used when wrapping the load based upon the determined density parameter for the load by determining a containment force requirement for the load based upon the determined density parameter.

39. The apparatus of claim 28, wherein the controller is configured to control the one or more control the one or more control parameters used when wrapping the load based upon the determined density parameter for the load by determining a wrap force or a number of layers of packaging material to be applied to the load based upon the determined density parameter.

40. The apparatus of claim 28, further comprising one or more sensors directed at the load and configured to sense a plurality of points on a plurality of surfaces of the load, wherein the controller is further configured to generate a surface model of the load based upon the sensed plurality of points, wherein the generated surface model identifies a top surface topography comprising a plurality of elevations for the load, and wherein the controller is further configured to determine whether the load has a nonstandard top layer based upon the generated surface model.

41. The apparatus of claim 40, wherein the controller is configured to determine whether the load has an inboard portion based upon the generated surface model.

42. The apparatus of claim 41, wherein the controller is configured to determine dimensions of the inboard portion of the load based upon the generated surface model.

43. The apparatus of claim 40, wherein the controller is further configured to activate a top layer containment operation when wrapping the load based upon determining the load has a nonstandard top layer.

44. The apparatus of claim 43, wherein the controller is further configured to select the activated top layer containment operation from among a plurality of top layer containment operations based upon the generated surface model.

45. The apparatus of claim 44, wherein the plurality of top layer containment operations includes a cross wrap containment operation and a U wrap containment operation.

46. The apparatus of claim 45, wherein the controller is configured to select the activated top layer containment operation from among the plurality of top layer containment operations by selecting between the cross wrap containment operation and the U wrap containment operation based upon at least one dimension of an inboard portion of the load determined from the generated surface model.

47. The apparatus of claim 43, wherein the controller is configured to control one or more control parameters for the top layer containment operation based upon the generated surface model.

48. The apparatus of claim 47, wherein the controller is configured to control the one or more control parameters for the top layer containment operation by controlling one or more of an elevation of a web of packaging material, a width of the web of packaging material, an elevation of an elevator of a packaging material dispenser, a speed of the elevator, an activation state of a roping mechanism, an elevation change start time, an elevation change start angle, or a top edge contact point based upon the generated surface model.

49. The apparatus of claim 28, further comprising one or more sensors directed at the load and configured to sense a plurality of points on a plurality of surfaces of the load, wherein the controller is further configured to generate a surface model of the load based upon the sensed plurality of points, and determine a verticality of at least one side of the load based upon the generated surface model.

50. The apparatus of claim 28, wherein the controller is configured to control the one or more control parameters used when wrapping the load based upon the determined density parameter for the load by selecting or configuring a wrap profile for the load based upon the determined density parameter for the load.

51. A program product, comprising:

a non-transitory computer readable medium; and program code stored on the non-transitory computer readable medium and configured to control a load wrapping apparatus of a type configured to wrap a load with packaging material dispensed from a packaging material dispenser through relative rotation between the packaging material dispenser and the load, wherein the program code is configured to control the load wrapping apparatus by performing a method that includes:

determining a density parameter for the load prior to wrapping the load, the density parameter describing a characteristic of the load prior to wrapping that is based on a relationship between a size of the load and a weight of the load; and controlling one or more control parameters for the load wrapping apparatus when wrapping the load based upon the determined density parameter for the load, wherein controlling the one or more control parameters for the load wrapping apparatus when wrapping the load based upon the determined density parameter for the load includes determining a stability for the load based upon the determined density parameter.

52. A method of controlling a load wrapping apparatus of a type configured to wrap a load on a load support with packaging material dispensed from a packaging material dispenser through relative rotation between the packaging material dispenser and the load support, the method comprising:

determining a volume for the load;

determining a weight for the load;

determining a density for the load prior to wrapping the load by determining a ratio between the volume and the weight for the load; and controlling one or more control parameters for the load wrapping apparatus when wrapping the load based upon the determined density for the load.

* * * * *